US010849811B2

(12) United States Patent
Nakata et al.

(10) Patent No.: US 10,849,811 B2
(45) Date of Patent: Dec. 1, 2020

(54) MASSAGE UNIT AND MASSAGE MACHINE HAVING MASSAGE UNIT

(71) Applicant: FAMILY INADA CO., LTD., Osaka (JP)

(72) Inventors: Yuichi Nakata, Tottori (JP); Tomoki Nagamitsu, Tottori (JP)

(73) Assignee: FAMILY INADA CO., LTD., Osaka (JP)

( * ) Notice: Subject to any disclaimer, the term of this patent is extended or adjusted under 35 U.S.C. 154(b) by 681 days.

(21) Appl. No.: 15/628,291

(22) Filed: Jun. 20, 2017

(65) Prior Publication Data

US 2017/0360641 A1 Dec. 21, 2017

(30) Foreign Application Priority Data

Jun. 20, 2016 (JP) ..... 2016-122148
Jun. 20, 2016 (JP) ..... 2016-122149

(51) Int. Cl.
*A61H 7/00* (2006.01)
*A61H 15/00* (2006.01)
(Continued)

(52) U.S. Cl.
CPC ..... *A61H 1/003* (2013.01); *A61H 7/007* (2013.01); *A61H 15/0078* (2013.01);
(Continued)

(58) Field of Classification Search
CPC ..... A61H 23/004; A61H 39/04; A61H 7/007; A61H 15/0078; A61H 2201/1676; A61H 2205/081; A61H 2201/1669; A61H 2201/1215; A61H 2015/0014; A61H 2201/1678; A61H 2201/1623; A61H 2203/0456; A61H 9/0078; A61H 23/006; A61H 23/02; A61H 23/0263; A61H 2007/009; A61H 2201/0149; A61H 2201/0192; A61H 2201/123; A61H 2201/164; A61H 2201/1645;
(Continued)

(56) References Cited

U.S. PATENT DOCUMENTS 6,056,707 A * 5/2000 Hayashi ..... A47C 3/02 601/99
6,117,094 A * 9/2000 Fujii ..... A61H 1/00 601/100

(Continued)

FOREIGN PATENT DOCUMENTS

JP 2003-250853 A 9/2003
JP 2004-202207 A 7/2004

*Primary Examiner* — Tu A Vo
(74) *Attorney, Agent, or Firm* — Michael Best & Friedrich LLP

(57) ABSTRACT

A massage unit includes a treatment member; an arm that supports the treatment member; a drive shaft that supports the arm and causes the treatment member to approach and be separated with respect to a treatment target site; a movable portion that causes the treatment member to be operable in a direction of being separated from the treatment target site when the treatment member comes into contact with the treatment target site by a force equal to or greater than predetermined strength; and biasing means for biasing the treatment member in an approaching direction.

21 Claims, 20 Drawing Sheets

(51) Int. Cl.
*A61H 1/00* (2006.01)
*A61H 1/02* (2006.01)

(52) U.S. Cl.
CPC ..... *A61H 1/006* (2013.01); *A61H 1/0237* (2013.01); *A61H 1/0274* (2013.01); *A61H 2001/0203* (2013.01); *A61H 2015/0028* (2013.01); *A61H 2015/0042* (2013.01); *A61H 2201/018* (2013.01); *A61H 2201/0149* (2013.01); *A61H 2201/1215* (2013.01); *A61H 2201/1409* (2013.01); *A61H 2201/164* (2013.01); *A61H 2201/1623* (2013.01); *A61H 2201/1669* (2013.01); *A61H 2201/5056* (2013.01); *A61H 2201/5061* (2013.01); *A61H 2201/5071* (2013.01); *A61H 2201/5079* (2013.01); *A61H 2205/081* (2013.01); *A61H 2205/10* (2013.01)

(58) Field of Classification Search
CPC .... A61H 2201/1654; A61H 2201/1664; A61H 2201/1666; A61H 2201/1671; A61H 2201/169; A61H 2201/50; A61H 2205/088; A61H 2205/106; A61H 7/00; A61H 7/002; A61H 7/004; A61H 15/00; A61H 2015/0007; A61H 2015/0021; A61H 2015/0028; A61H 2015/0035; A61H 2015/0042; A61H 2015/005; A61H 2015/0057; A61H 1/003; A61H 1/006; A61H 1/0237; A61H 1/0274; A61H 2001/0203; A61H 2201/018; A61H 2201/1409; A61H 2201/5056; A61H 2201/5061; A61H 2201/5071; A61H 2201/5079; A61H 2205/10
See application file for complete search history.

(56) References Cited

U.S. PATENT DOCUMENTS 6,540,701 B1 * 4/2003 Inada ..... A61H 39/04 601/100
2007/0016119 A1 * 1/2007 Inada ..... A61H 9/0078 601/151
2008/0097260 A1 * 4/2008 Tsukada ..... A61H 15/0078 601/98
2012/0071799 A1 * 3/2012 Inada ..... A61H 7/004 601/98
2012/0215143 A1 * 8/2012 Inada ..... A61H 1/003 601/112
2013/0088059 A1 * 4/2013 Nagamitsu ..... A47C 3/02 297/260.2
2014/0343467 A1 * 11/2014 Fukuyama ..... A61H 7/007 601/98

* cited by examiner

FIG. 19

| LEVEL | 1 | 2 | 3 | 4 | 5 |
|---|---|---|---|---|---|
| DETECTION ROTATIONAL SPEED (ROTATIONS/SECOND) | 10~15 | 16~20 | 21~25 | 26~30 | 31~35 |
| AIMED ROTATIONAL SPEED (ROTATIONS/SECOND) | 28 | 18 | 23 | 28 | 33 |
| ROTATING DIRECTION | INVERSE | NORMAL | NORMAL | NORMAL | NORMAL |
| AIR SUPPLY/ DISCHARGE DEVICE | DISCHARGE | DISCHARGE | SUPPLY | SUPPLY | SUPPLY |

FIG. 20

| LEVEL | 1 | 2 | 3 | 4 | 5 |
|---|---|---|---|---|---|
| DETECTION PRESSURE (kPa) | 40 | 39 | 38 | 37 | 36 |
| AIMED ROTATIONAL SPEED (ROTATIONS/SECOND) | 28 | 18 | 23 | 28 | 33 |
| ROTATING DIRECTION | INVERSE | NORMAL | NORMAL | NORMAL | NORMAL |
| AIR SUPPLY/ DISCHARGE DEVICE | DISCHARGE | DISCHARGE | SUPPLY | SUPPLY | SUPPLY |

MASSAGE UNIT AND MASSAGE MACHINE HAVING MASSAGE UNIT

This application claim the Convention priority based on Japanese Patent Application Nos. 2016-122148 and 2016-122149 filed on Jun. 20, 2016, the contents of which, including the specification, the claim and the drawings, are incorporated herein by reference in their entirety.

TECHNICAL FIELD

The present invention relates to a massage machine.

BACKGROUND ART

In the related art, there is a known massage machine including a kneading ball arm that is provided with a treatment member in an end portion, and a drive arm that performs a kneading operation or a patting operation (for example, refer to FIG. 2 of JP-2003-250853-A). In the massage machine, a sub arm is interposed between the kneading ball arm and the drive arm, and a vertical torsion spring is provided in an interlock portion of the sub arm and the drive arm. The vertical torsion spring is torsionally rotatable around a shaft center in the vertical direction. Therefore, flexible pressurizing feeling can be obtained.

In addition, there is a known massage machine in which an air cell is provided in a support base portion supporting lower thighs and a roller that is movable in the longitudinal direction of the lower thighs is provided at a position facing the support base portion (for example, refer to FIG. 2 of JP-2004-202207-A). In the massage machine, rubbing and kneading can be performed with respect to the lower thighs by moving the roller in a state where the lower thighs are sandwiched by the air cell and the roller.

SUMMARY OF THE INVENTION

The present invention includes a treatment member, an arm that supports the treatment member, a drive shaft that supports the arm and causes the treatment member to approach and be separated with respect to a treatment target site, a movable portion that causes the treatment member to be operable in a direction of being separated from the treatment target site when the treatment member comes into contact with the treatment target site by a force equal to or greater than predetermined strength, and biasing means for biasing the treatment member in the approaching direction.

The arm may have a first arm which is supported by the drive shaft, a second arm which is supported by the first arm via the movable portion, and a turning shaft which serves as the movable portion causing the second arm to be turnably interlocked with the first arm. It is preferable that the biasing means biases the second arm to turn in a direction in which the treatment member approaches the treatment target site.

The biasing means may have an elastic member which is interposed between the first arm and the second arm.

The elastic member may pull a base portion on a side opposite to the treatment member side of the second arm.

BRIEF DESCRIPTION OF THE DRAWINGS

FIG. 19 is a view describing controlling of the motor and an air supply/discharge device in accordance with a detection result of a sensor.

FIG. 20 is a view describing controlling of the motor and the air supply/discharge device in accordance with a detection result of a sensor.

DETAILED DESCRIPTION OF THE INVENTION

Overall Configuration of Massage Machine

Hereinafter, the overall configuration of a massage machine 1 of the present invention will be described.

As the concept of directions used in the description below, when viewed from a user who takes a seat in the massage machine 1, the head side in the height direction is defined as "up", the toe side in the height direction is defined as "down", a direction toward the front side of the body (for example, side of face, chest, abdomen, and shin) is defined as "front", a direction toward the back side of the body (for example, side of occipital region, back, waist, and calf) is defined as "rear", the left hand is defined as "left", and the right hand side is defined as "right". Other cases will be suitably described.

Figure 1:
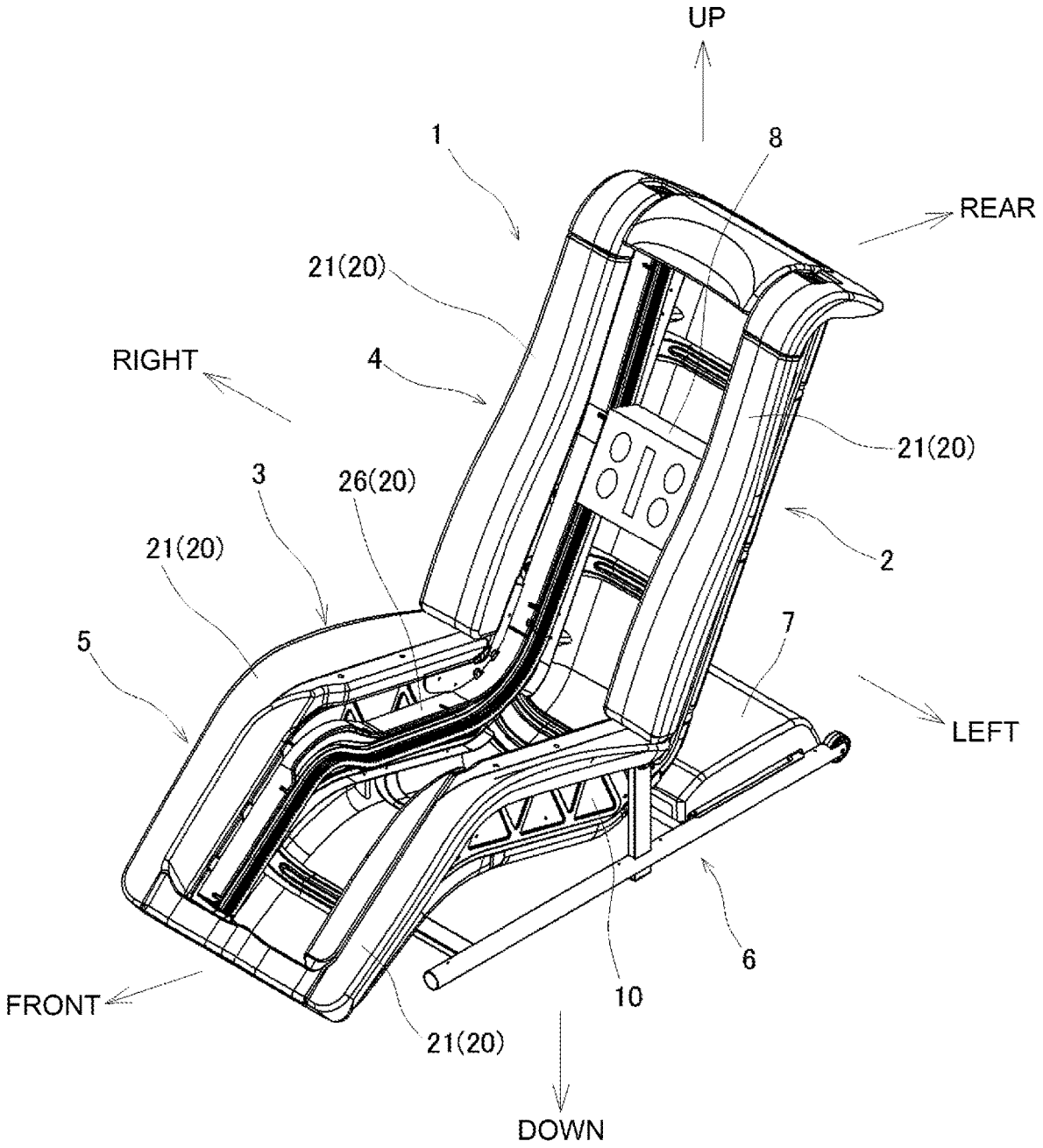
FIG. 1 is a perspective view of a massage machine in an up-right posture according to an embodiment of the present invention.
Figure 2:
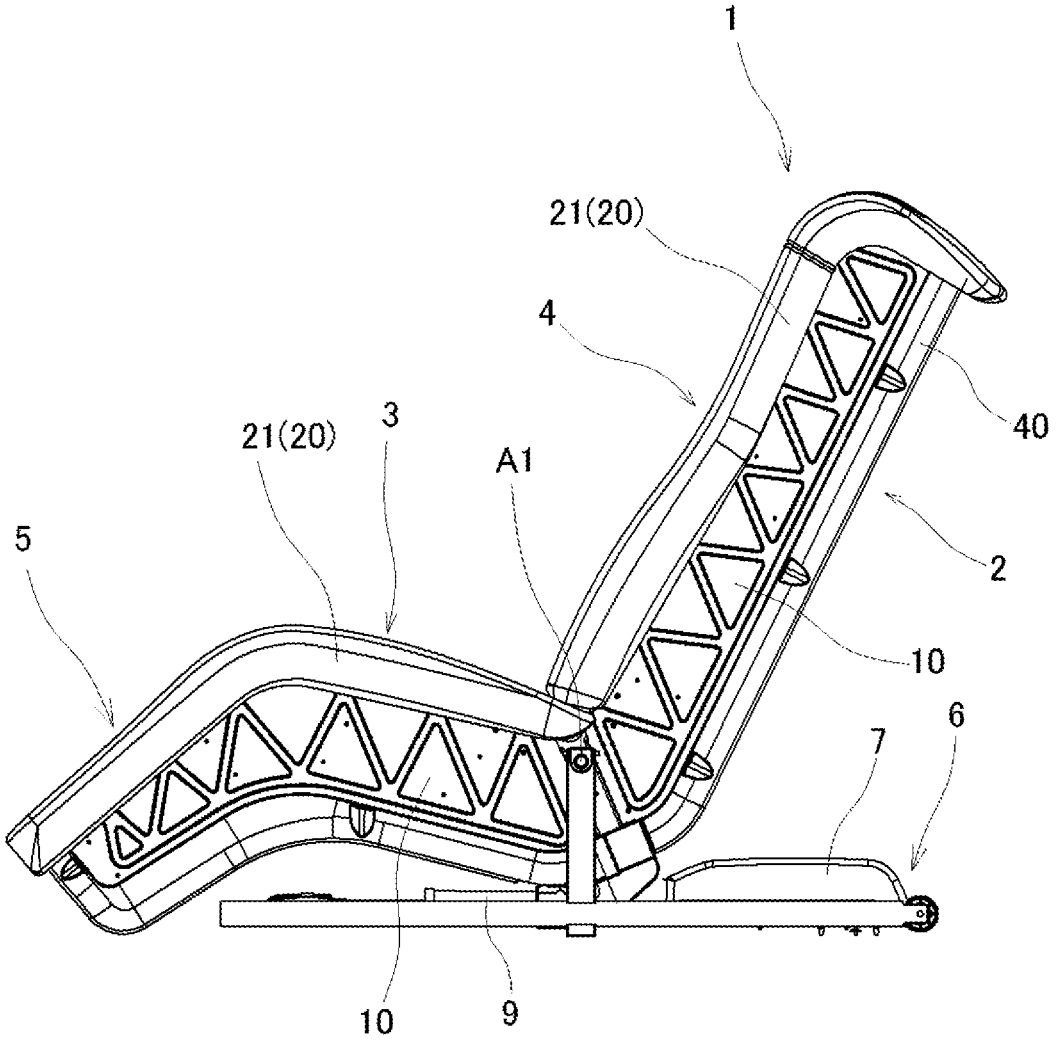
FIG. 2 is a right side view of the massage machine in an up-right posture.
Figure 3:
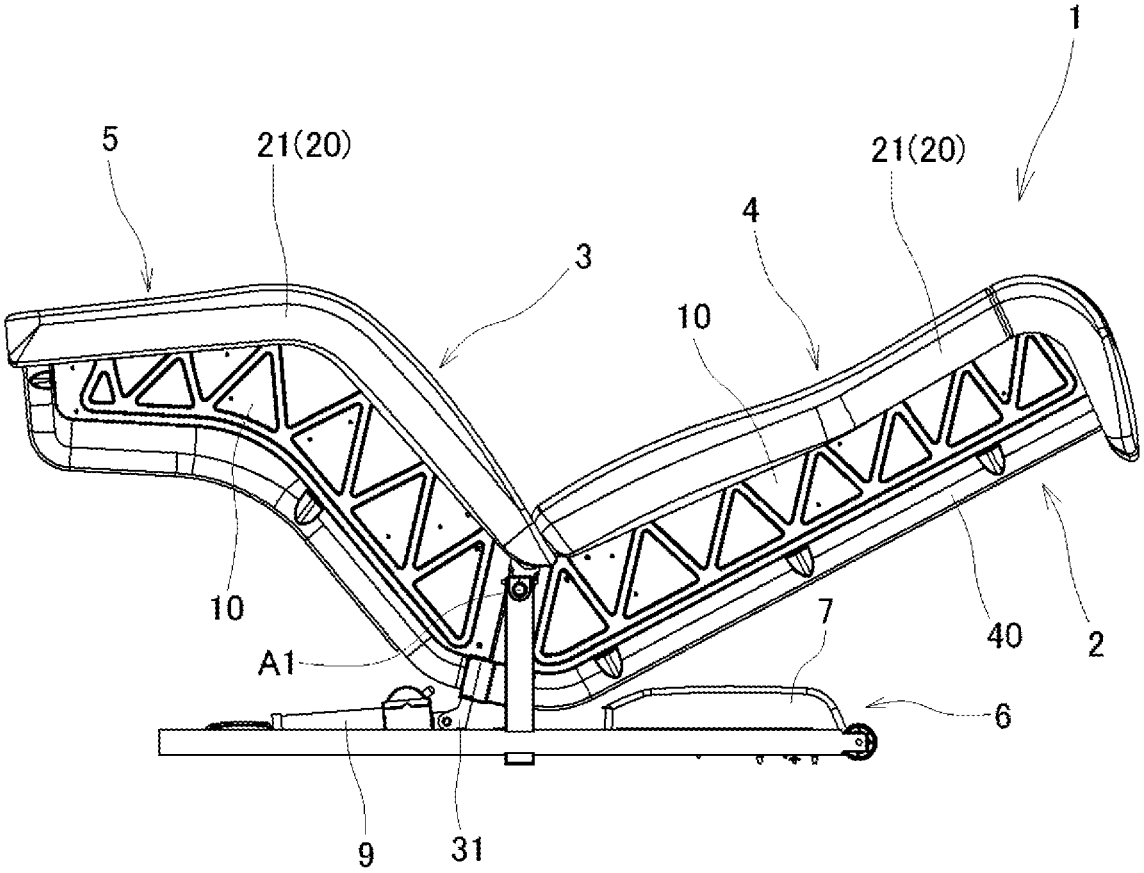
FIG. 3 is a right side view of the massage machine in a reclined posture.
Figure 4:
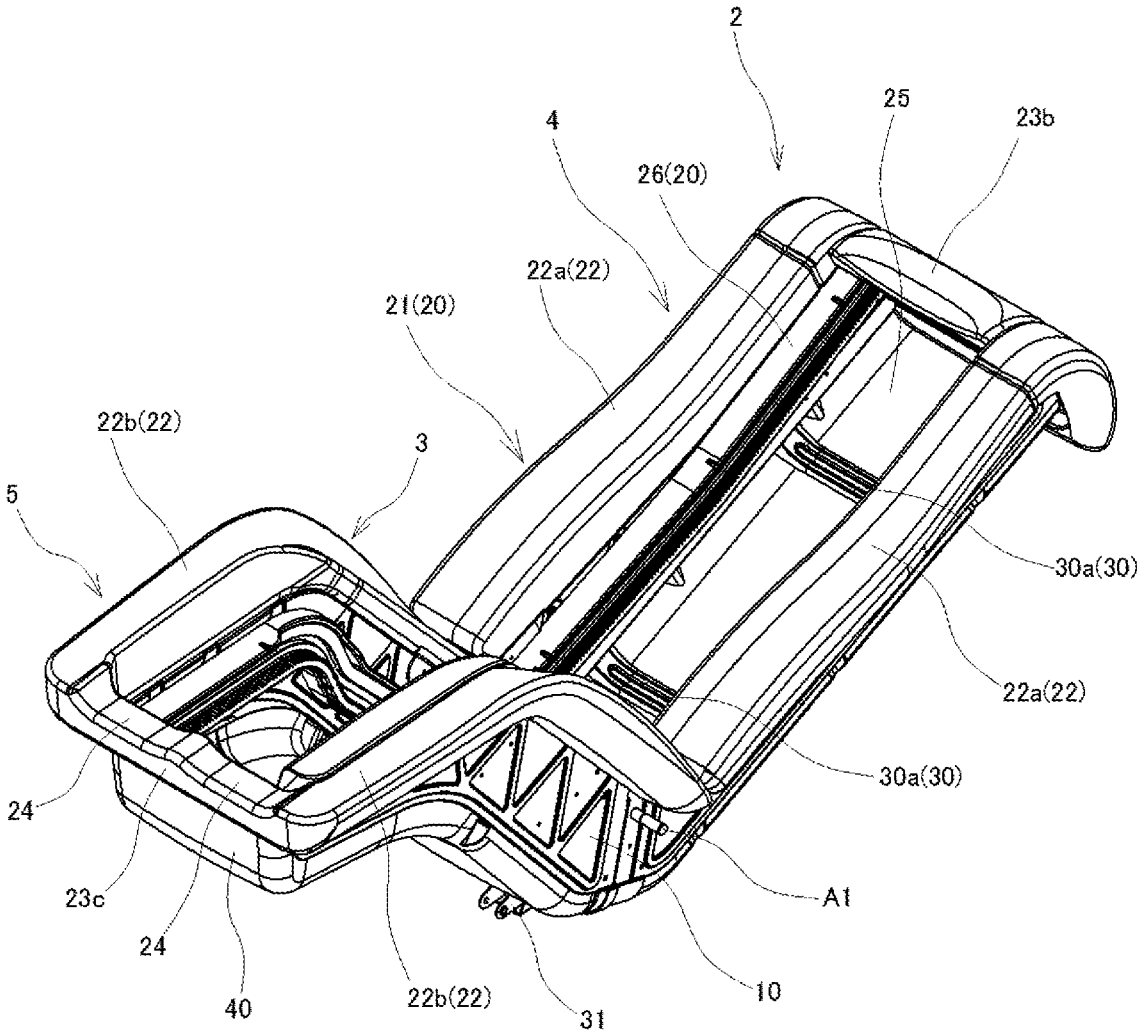
FIG. 4 is a perspective view of a chair main body.
Figure 5:
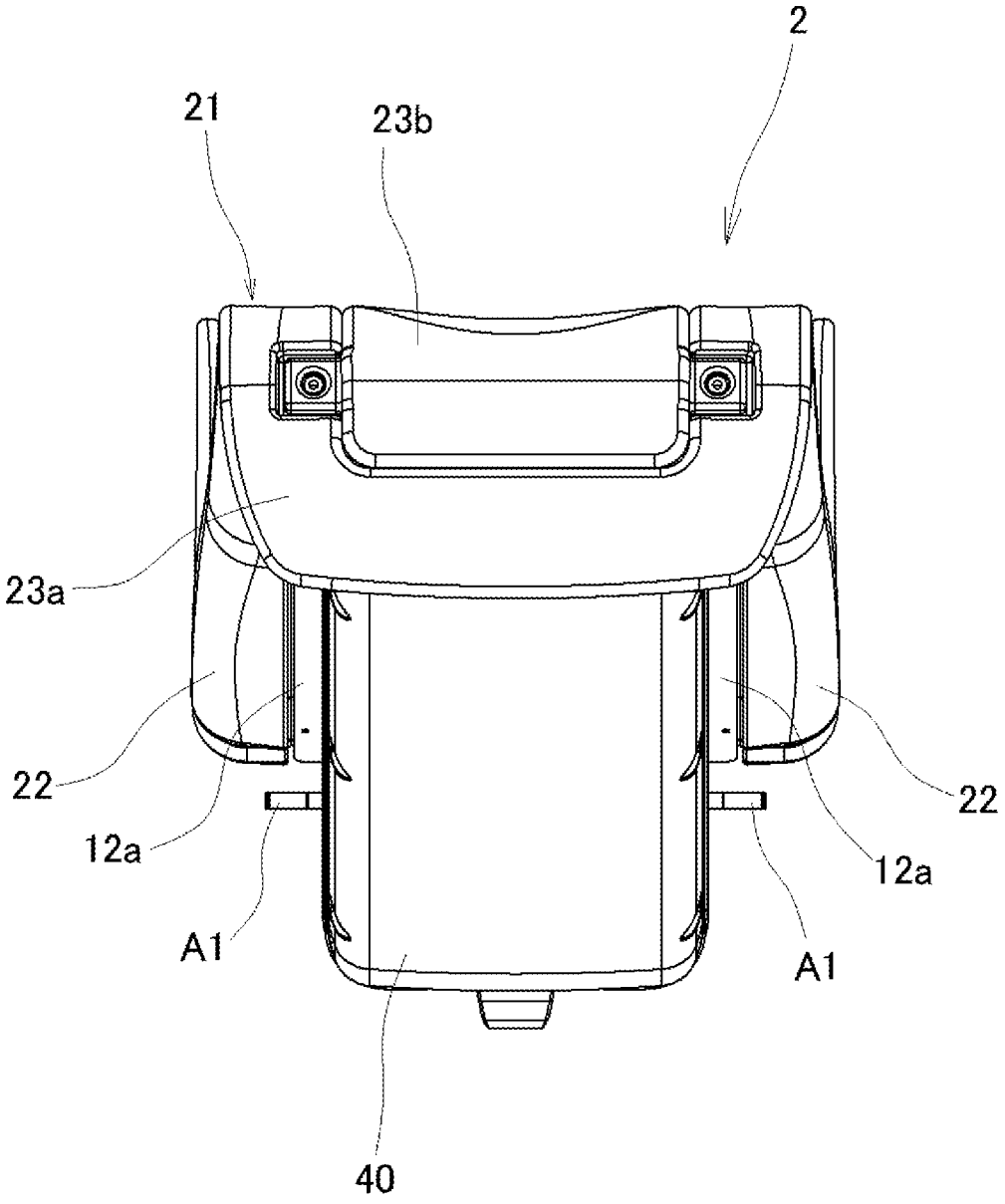
FIG. 5 is a rear view of the chair main body illustrated in FIG. 4.
Figure 6:
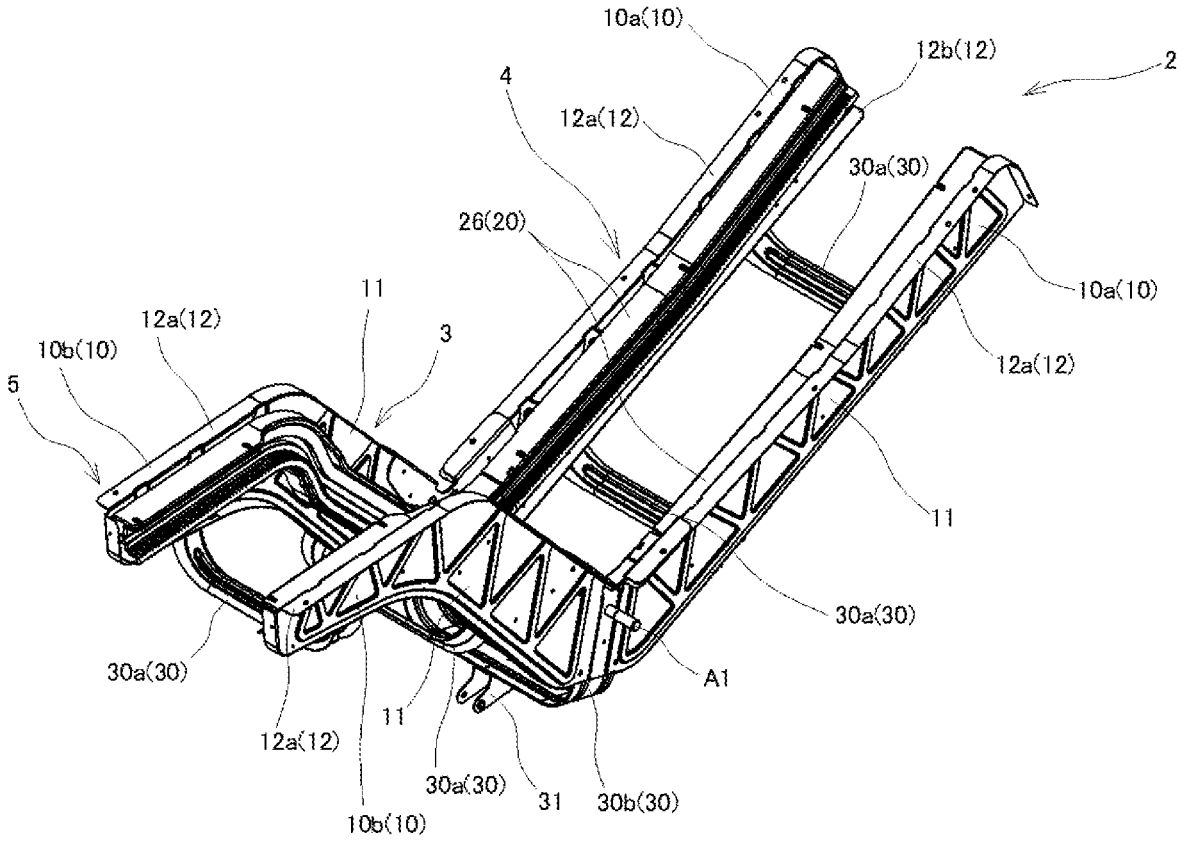
FIG. 6 is a perspective view of the chair main body.
Figure 7:
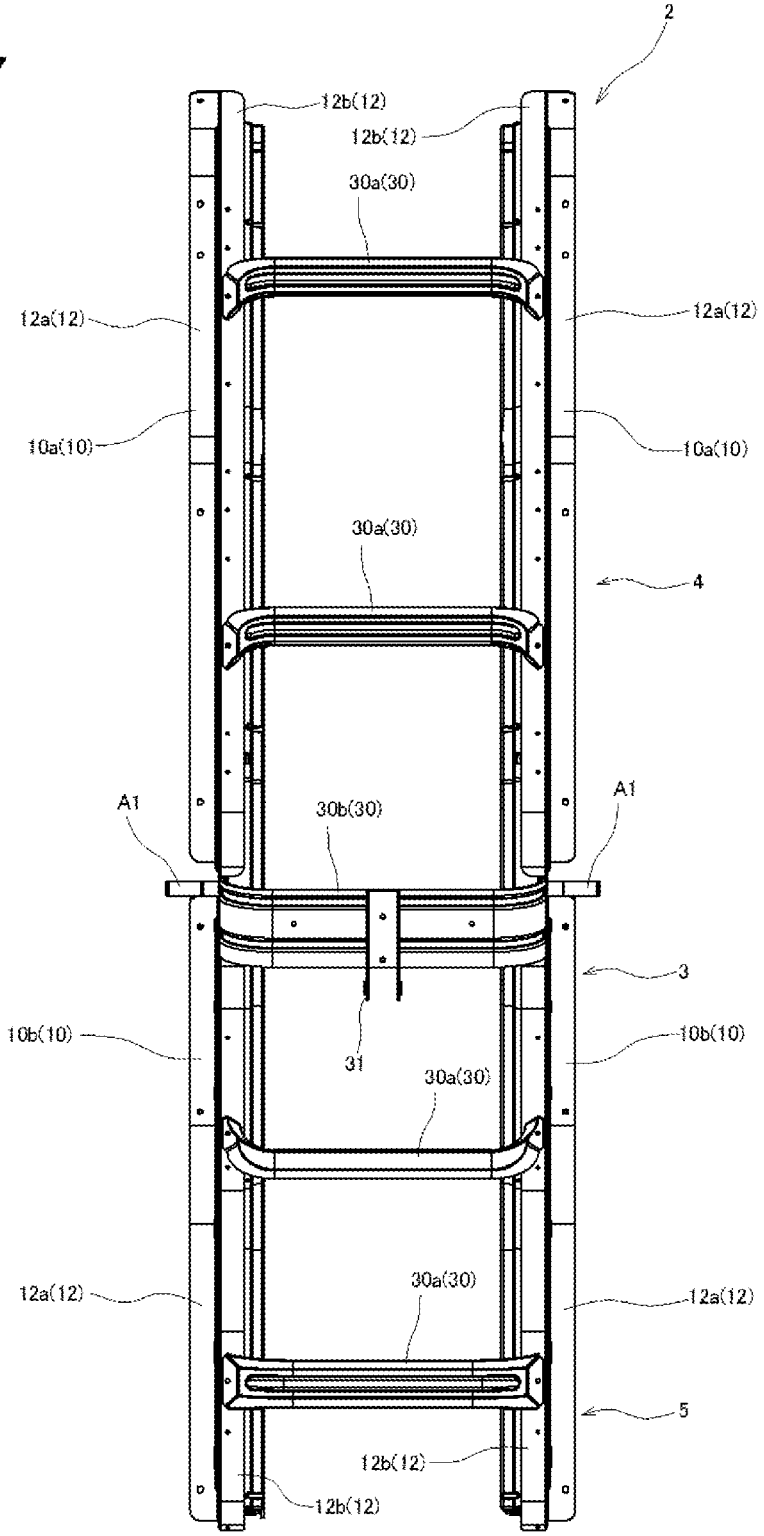
FIG. 7 is a bottom view of the chair main body illustrated in FIG. 6.
Figure 8:
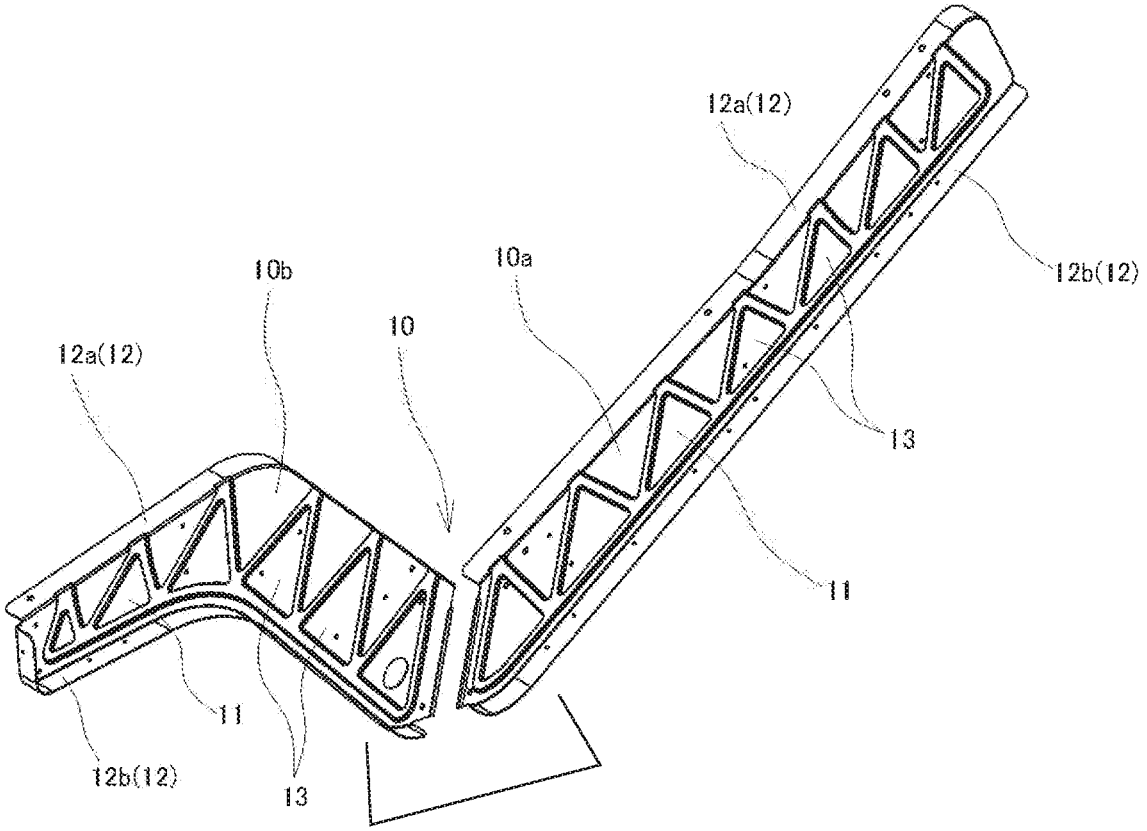
FIG. 8 is a perspective view of a first frame on the right side.
Figure 9:
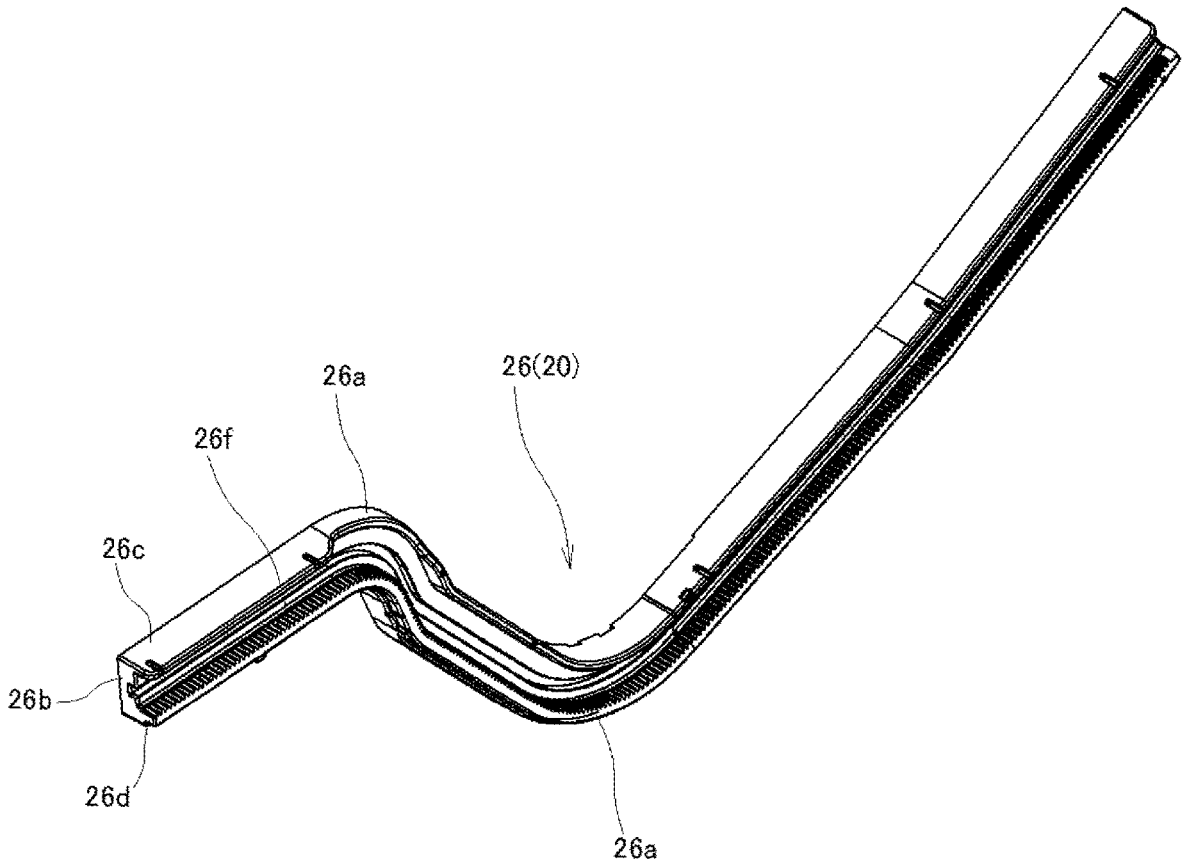
FIG. 9 is a perspective view of a guide rail on the right side.

FIG. 1 is a perspective view of the massage machine 1 in an up-right posture according to an embodiment of the present invention. FIG. 2 is a right side view of the massage machine 1 in an up-right posture. FIG. 3 is a right side view of the massage machine 1 in a reclined posture. FIG. 4 is a perspective view of a chair main body 2. FIG. 5 is a rear view of the chair main body 2 illustrated in FIG. 4. FIG. 6 is a perspective view of the chair main body 2. FIG. 7 is a bottom view of the chair main body 2 illustrated in FIG. 6. FIG. 8 is a perspective view of a first frame 10 on the right side. FIG. 9 is a perspective view of a guide rail 26 on the right side. In FIGS. 6 and 7, a body placement portion 21 and a back cover 40 are omitted and are not illustrated.

As illustrated in FIGS. 1 to 3, the massage machine 1 of the present invention mainly has the chair main body 2 including a seat portion 3 in which the user takes a seat, a backrest portion 4 which is provided in the rear of the seat portion 3 and on which the user leans, and a footrest 5 which is provided in the front of the seat portion 3 and supports the lower limbs of the user; a leg frame 6 supporting the chair main body 2 from the floor surface at a predetermined height; a control unit 7 controlling various types of operations of the chair main body 2; and a controller C (refer to FIG. 17) performing various types of operations of the massage machine 1. The chair main body 2 functions as a body support portion supporting the body of the user. In the present embodiment, the seat portion 3, the backrest portion 4, and the footrest 5 are integrally configured. However, the seat portion 3 and the backrest portion 4 may be separately provided as independent bodies, and the seat portion 3 and the footrest 5 may be separately provided as independent bodies. The chair main body 2 is provided with the massage unit 8 which performs a kneading massage and/or a patting massage. The massage unit 8 is movable along the height direction, and it is preferable to be movable from the backrest portion 4 to the footrest 5 via the seat portion 3. On both the right and left sides of the seat portion 3, armrest portions (not illustrated) on which the arms of the user are placed may be respectively provided.

The chair main body 2 is interlocked with the leg frame 6 via pivot shafts A1 having the rightward/leftward direction as the axial direction. In addition, between the chair main body 2 and the leg frame 6, there is provided an actuator 9 causing the chair main body 2 to be reclined in the forward/rearward direction. The actuator 9 is configured with a direct drive-type actuator performing a stretching/contracting operation. When the actuator 9 performs a stretching/contracting operation, the chair main body 2 can stop at an arbitrary position between the up-right posture illustrated in FIG. 2 and the reclined posture illustrated in FIG. 3. The control unit 7 controls driving of the actuator 9.

Configuration of Chair Main Body

As illustrated in FIGS. 4 to 8, the chair main body 2 (body support portion) mainly has the first frames 10 which form a pair on the right and the left and are made of plate-like metal having plate surfaces in the rightward/leftward direction, second frames 20 which are respectively and fixedly attached to the first frames 10 and are made of resins having predetermined thicknesses in the rightward/leftward direction, third frames 30 which cause the first frames 10 on the right and the left to be interlocked with each other, the back cover 40 which covers the massage unit 8 from the back side, and a front cover (not illustrated) which covers the massage unit 8 from the front side and is made of flexible texture or the like. In the present embodiment, the back cover 40 is configured through injection molding using a resin. However, the back cover 40 may be configured through vacuum molding using a resin or may be configured to be made of plate-like metal similar to the first frame 10.

Configuration of First Frame

As illustrated in FIG. 8, the first frame 10 is separated into an upper first frame 10*a* which is provided at a position corresponding to the backrest portion 4, and a lower first frame 10*b* which is provided at a position corresponding to the seat portion 3 and the footrest 5. The upper first frame 10*a* is shaped so as to be slightly uplifted forward at a position corresponding to the waist in a side view. The lower first frame 10*b* is shaped so as to be bent downward at a position corresponding to the knees in a side view. In other words, the front side of the first frame 10 is shaped along the back side of the body of the user who takes a seat in the chair main body 2.

The first frames 10 include side portions 11 having plate surfaces in the rightward/leftward direction, and extension portions 12 respectively extending in the rightward/leftward direction from both end portions of the side portions 11 in the front/back direction. In the side portion 11, ribs 13 of substantially triangular projection portions and recess portions in a side view are formed, and the ribs 13 contribute to ensuring the strength of the first frame 10. The extension portion 12 has a first extension portion 12*a* extending transversely outward from the front side, and a second extension portion 12*b* extending transversely inward from the back side. The extension portion 12 contributes to ensuring the strength of the first frame 10 in the rightward/leftward direction. In other words, the first frame 10 can be prevented from being deformed in the rightward/leftward direction. The extension portion 12 and the ribs 13 can be collectively formed by pressing one metal plate. Therefore, the extension portion 12 is formed across the overall length of the side portion 11 in the height direction.

As described above, since the first frame 10 is configured to be made of plate-like metal having the plate surface in the rightward/leftward direction, the first frame 10 can be easily bent through pressing, and the ribs 13 can also be easily formed. Therefore, the chair main body 2 can be manufactured at low cost. In addition, since there is no need to separately provide an exterior configuring member (for example, an exterior panel made of a resin or the like) around the first frame 10, the number of components can be reduced. In addition, it is possible to ensure the strength in a direction (front/back direction) orthogonal to the rightward/leftward direction in which the weight of the user significantly acts.

Configuration of Second Frame (Body Placement Portion)

As illustrated in FIGS. 4 to 9, the second frame 20 has the body placement portion 21 in which the body of the user is placed, and the guide rail 26 which guides movement of the massage unit 8 along the height direction. In the present embodiment, the body placement portion 21 and the guide rail 26 are configured to be made of resins. However, the body placement portion 21 and the guide rail 26 are acceptable as long as at least any one thereof is configured to be made of a resin. Examples of the resin include various resin materials such as polypropylene (PP), acrylonitrile-butadiene-styrene (ABS), and chip urethane.

The body placement portion 21 has first portions 22 which extend in the height direction and form a pair on the right and the left, and second portions 23*a* to 23*c* which extend in the rightward/leftward direction. As illustrated in FIGS. 5 and 6, the first portions 22 are respectively and fixedly attached to the first extension portions 12*a* of the first frames 10 on the right and the left. Specifically, the first portion 22 is screwed from the back side in a state of being placed on the front side of the first extension portion 12*a*. As illustrated in FIG. 4, similar to the first frame 10, the first portion 22 is separated into an upper first portion 22*a* which is provided at the position corresponding to the backrest portion 4, and a lower first portion 22*b* which is provided at the position corresponding to the seat portion 3 and the footrest 5. The upper first portion 22*a* is shaped so as to be slightly uplifted forward at the position corresponding to the waist in a side view. The lower first portion 22*b* is shaped so as to be bent downward at the position corresponding to the knees in a side view. In other words, the front side of the first portion 22 is shaped along the back side of the user who takes a seat in the chair main body 2.

The inner sides of the first portions 22 on the right and the left are respectively and fixedly attached to the first extension portions 12*a*, and the first portion 22 has a transverse size longer than that of the first extension portion 12*a*. In other words, the body placement portion 21 has a predetermined thickness in the rightward/leftward direction. Since the first extension portions 12*a* extend transversely outward from the front side of the side portions 11, the first portions 22 forming a pair on the right and the left can be separately disposed. Therefore, even though the transverse size of the body placement portion 21 is not increased, the body placement portion 21 can stably support the body (particularly, the side parts of the body). In addition, since the second frame 20 is configured to be made of a resin having a predetermined thickness in the rightward/leftward direction, it is possible to ensure the strength of the chair main body 2 in the rightward/leftward direction. In other words, the first frame 10 made of plate-like metal can be prevented from being deformed in the rightward/leftward direction.

As illustrated in FIGS. 4 to 6, the second portions 23*a* to 23*c* are fixedly attached to the first extension portions 12*a* in the first frames 10 on the right and the left. Specifically, the second portions 23*a* to 23*c* are screwed from the back side in a state of being placed on the front side of the first extension portion 12*a*. The second portions 23*a* to 23*c* are provided on the head side and the leg tip side. The second portions 23*a* and 23*b* on the head side are the second portion 23*a* configuring the top surface of the backrest portion 4, and the second portion 23*b* configuring the front surface of the backrest portion 4. The second portion 23*a* is integrally configured with the first portions 22. The second portion 23*b* is a member independent from the first portions 22, and the outer surface thereof is provided so as to be in contact with the inner surfaces of the first portions 22. The second portion 23*b* can support the body (particularly, the head). The second portion 23*c* on the leg tip side is integrally configured with the first portions 22. The second portion 23*c* can support the body (particularly, the lower limbs). In addition, in the second portion 23*c*, recess portions 24 which have recessed cross sections orthogonal to the height direction and form a pair on the right and the left are formed so as to be able to dividedly support the right and left lower limbs.

Since the second portions 23*a* and 23*c* extending in the rightward/leftward direction are integrally configured with the first portions 22 and/or the second portion 23*b* extending in the rightward/leftward direction is provided so as to be in contact with the inner surfaces of the first portions 22, the pair of first frames 10 separately disposed in the rightward/leftward direction can be prevented from tilting transversely inward or outward due to the weight of the user. In other words, it is possible to ensure the strength of the chair main body 2 in the rightward/leftward direction. In addition, in the body placement portion 21, openings 25 which are open in the front/back direction are formed due to the first portions 22 extending in the height direction and forming a pair on the right and the left, and the second portions 23*a* to 23*c* on the head side and the leg tip side extending in the rightward/leftward direction. With respect to the back side of the body placed in the body placement portion 21, the massage unit 8 can perform a massage through the openings 25.

Configuration of Second Frame (Guide Rail)

As illustrated in FIGS. 6 and 9, the guide rails 26 extend along the height direction and are respectively and fixedly attached to the side portions 11 of the first frames 10 on the right and the left. Specifically, the guide rails 26 are screwed from the outside to the right and the left in a state of being in contact with the inner surfaces of the side portions 11. The guide rail 26 is provided at a position corresponding to each of the backrest portion 4, the seat portion 3, and the footrest 5. The guide rail 26 has curve portions 26*a* in the vicinity of the boundary of the seat portion 3 and the backrest portion 4 and in the vicinity of the boundary of the seat portion 3 and the footrest 5. Therefore, the massage unit 8 is movable along the guide rails 26 within a range from the backrest portion 4 to the footrest 5 via the seat portion 3.

Figure 10:
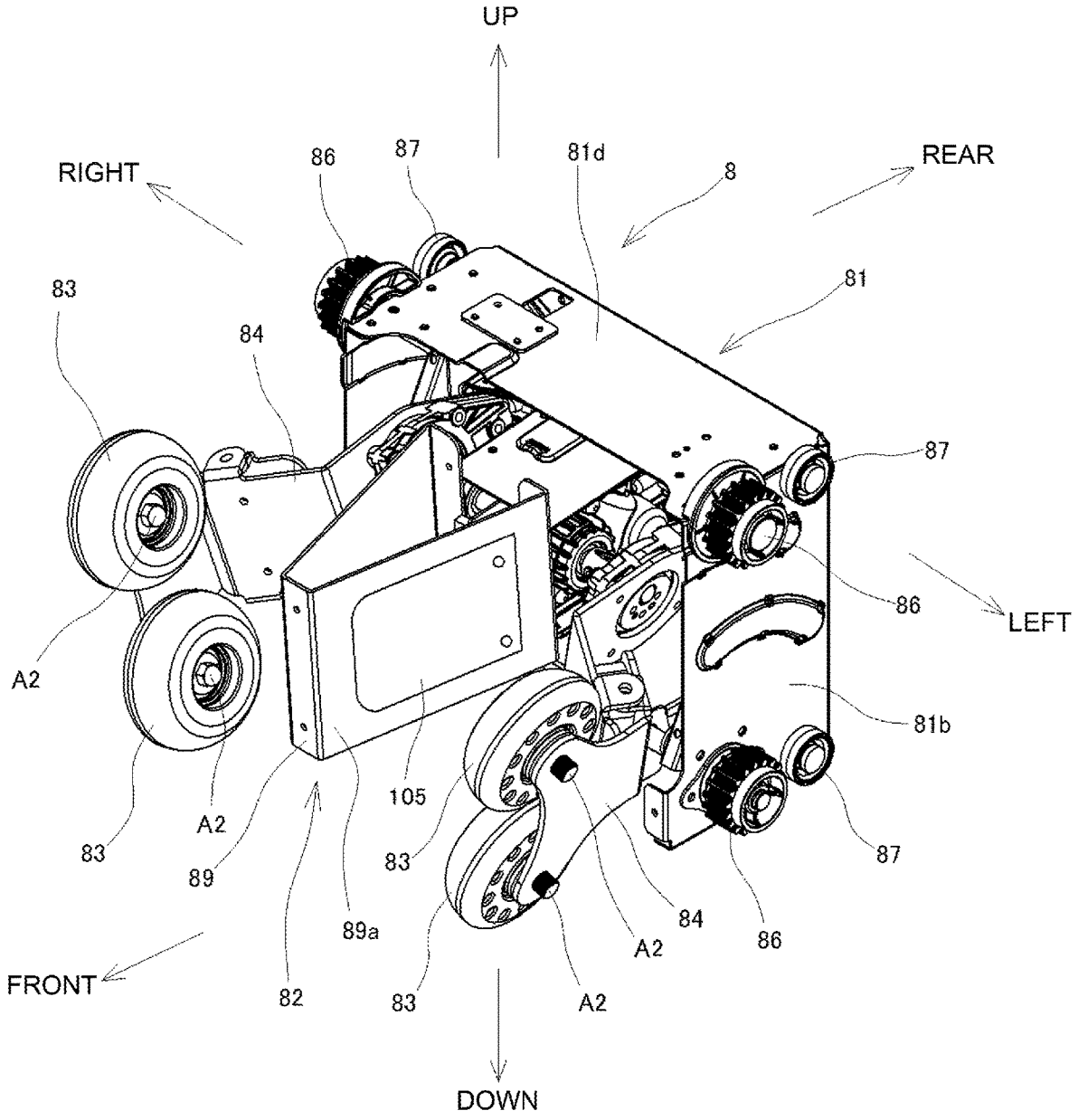
FIG. 10 is a perspective view of a massage unit.

A cross section of the guide rail 26 orthogonal to the height direction is formed so as to have a substantially U-shape which is open transversely inward. Specifically, the guide rail 26 has a first wall portion 26*b* which comes into contact with the side portion 11, a second wall portion 26*c* which stands transversely inward from one end portion of the first wall portion 26*b*, and a third wall portion 26*d* which stands transversely inward from the other end portion of the first wall portion 26*b*. In other words, the guide rail 26 has a predetermined thickness in the rightward/leftward direction. As illustrated in FIGS. 9 and 10, on the front side of the third wall portion 26*d*, there is provided a rack 26*f* with which a pinion 86 of the massage unit 8 engages. In addition, the back side of the third wall portion 26*d* serves as a rolling contact surface with which the guide roller 87 of the massage unit 8 is in rolling-contact. In other words, the third wall portion 26*d* is sandwiched by the pinion 86 and the guide roller 87. When the pinion 86 rotates, the massage unit 8 is movable along the height direction.

As described above, since the second frame 20 is configured to be made of a resin having a predetermined thickness in the rightward/leftward direction, it is possible to ensure the strength of the chair main body 2 in the rightward/leftward direction. In addition, since the first frames 10 made of plate-like metal and the second frames 20 made of resins are combined together and configure the chair main body 2, it is possible to reduce the weight compared to (frames of) chair main bodies in the related art each of which is a combination of metal pipe members. In addition, since the second frame 20 is screwed to the first frame 10, welding work can be reduced.

Configuration of Third Frame

As illustrated in FIGS. 6 and 7, the chair main body 2 has the third frame 30 which is installed across the first frame 10 on the left side and the first frame 10 on the right side. Similar to the first frame 10, the third frame 30 is configured to be made of plate-like metal and causes the first frames 10 on the right and the left to be interlocked with each other. A plurality of the third frames 30 are provided along the height direction. Specifically, two third frames 30 are provided at positions corresponding to the backrest portion 4, one third frame 30 is provided at a position corresponding to the seat portion 3, one third frame 30 is provided at a position corresponding to the footrest 5, and one third frame 30 is provided in the vicinity of the boundary of the seat portion 3 and the backrest portion 4. A third frame 30*a* at a position corresponding to the backrest portion 4, the seat portion 3, and the footrest 5 is screwed from the back side so as to be fixedly attached to the second extension portions 12*b* of the first frames 10. A third frame 30*b* at a position corresponding to the boundary of the seat portion 3 and the backrest portion 4 is screwed from the outside to the right and the left and from the upper side so as to be fixedly attached to the side portions 11 and the first extension portions 12*a* of the first frames 10. The third frame 30*b* causes the upper first frame 10*a* and the lower first frame 10*b* to be interlocked with each other. On the outsides of the third frames 30*b* on the right and the left, there are provided the pivot shafts A1 which cause the chair main body 2 and the leg frame 6 to be interlocked with each other. In addition, at a transversely substantial center on the back side of the third frame 30*b*, there is provided a bracket 31 which causes the actuator 9 to be interlocked.

The third frames 30 installed across the first frame 10 on the left side and the first frame 10 on the right side can prevent the pair of first frames 10 separately disposed in the rightward/leftward direction from tilting transversely inward or outward due to the weight of the user. In other words, it is possible to ensure the strength of the chair main body 2 in the rightward/leftward direction. The back cover 40 is fixedly attached to the first frames 10 and the third frames 30. Specifically, the back cover 40 is screwed to the second extension portions 12*b* of the first frames 10 from the back side and is screwed to the third frames 30 from the back side. The back cover 40 can cover the massage unit 8 from the back side.

Configuration of Massage Unit

Hereinafter, the configuration of the massage unit 8 will be described. The massage unit 8 of the present embodiment has a structure suitable for massaging the lower limbs of the user. Accordingly, description will be given by exemplifying a case where the lower limbs are taken as a treatment target site. Naturally, a different site can also be taken as the treatment target site in place of the lower limbs.

Figure 11:
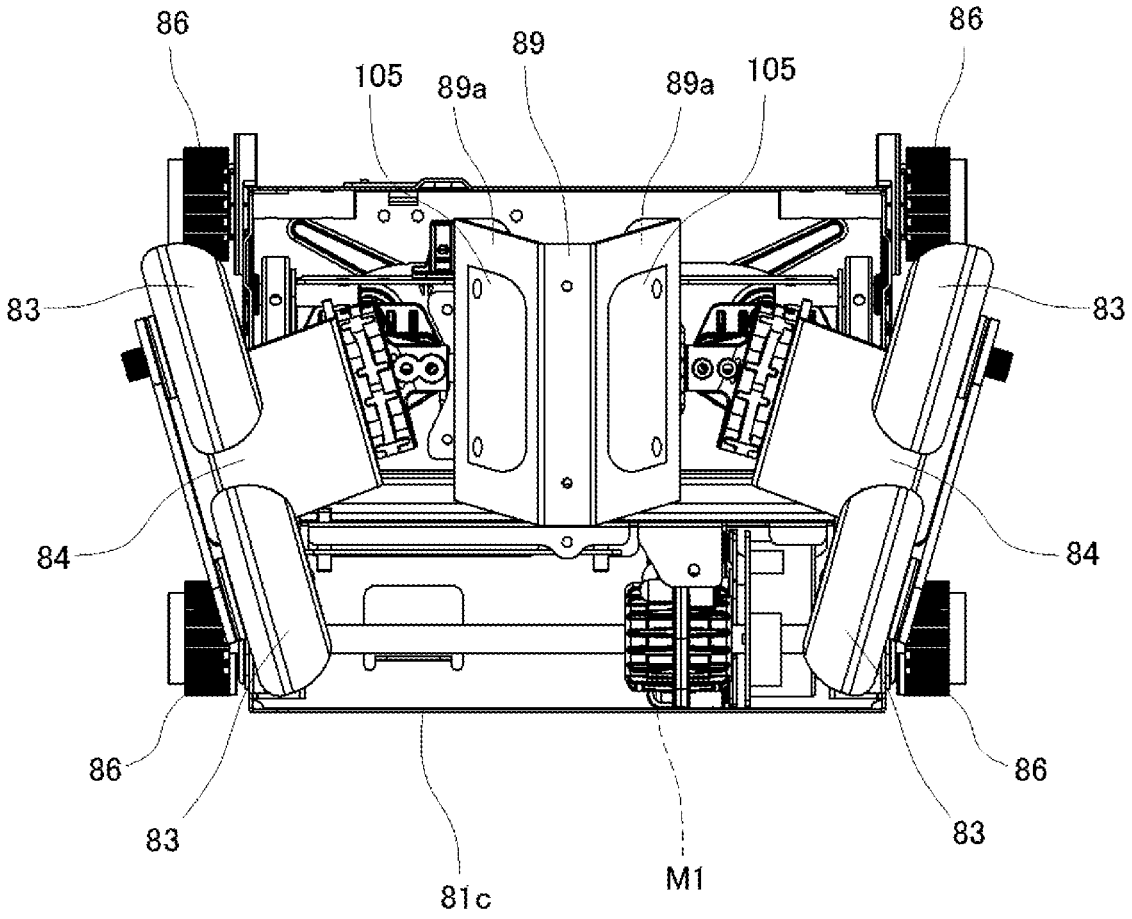
FIG. 11 is a front view of the massage unit.
Figure 12:
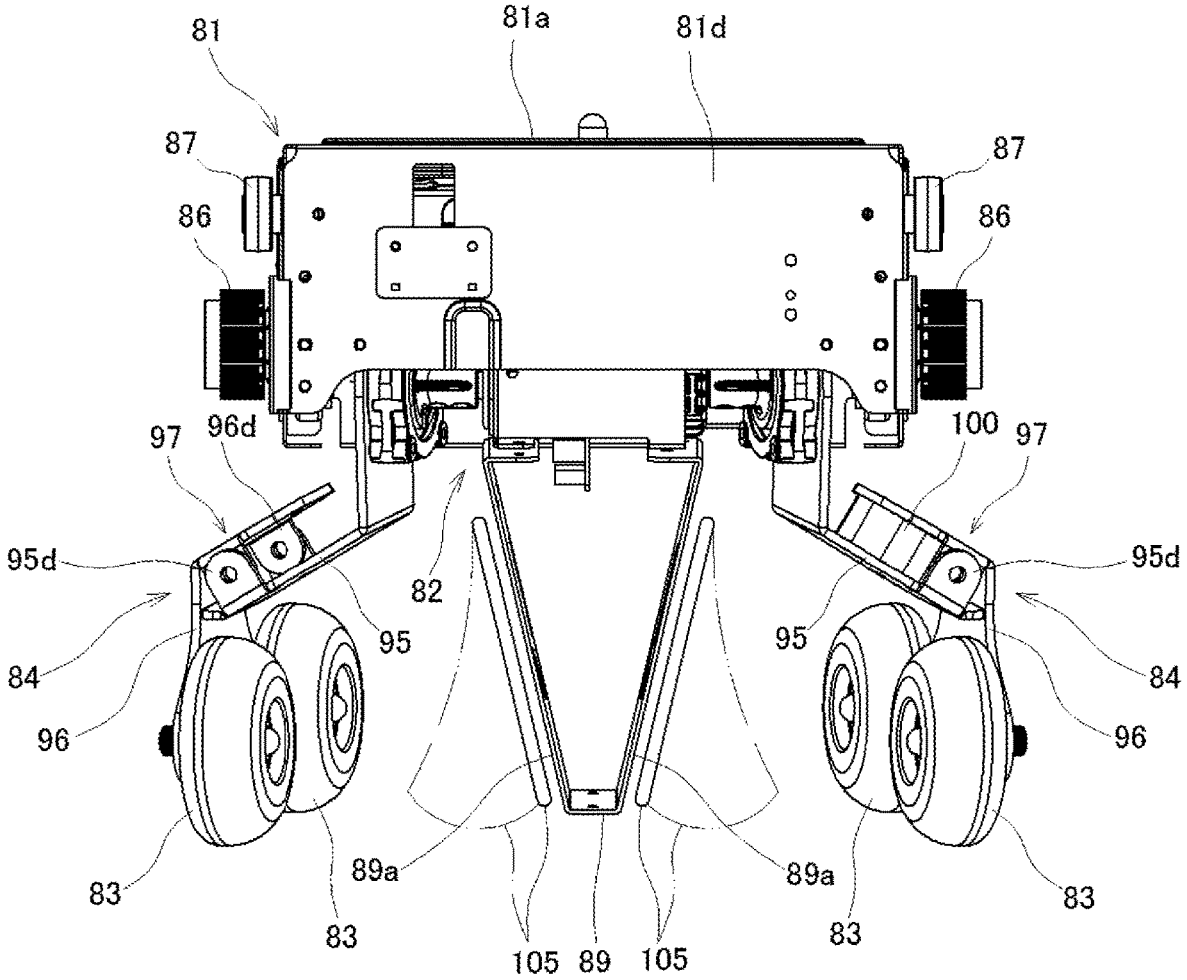
FIG. 12 is a plan view of the massage unit.
Figure 13:
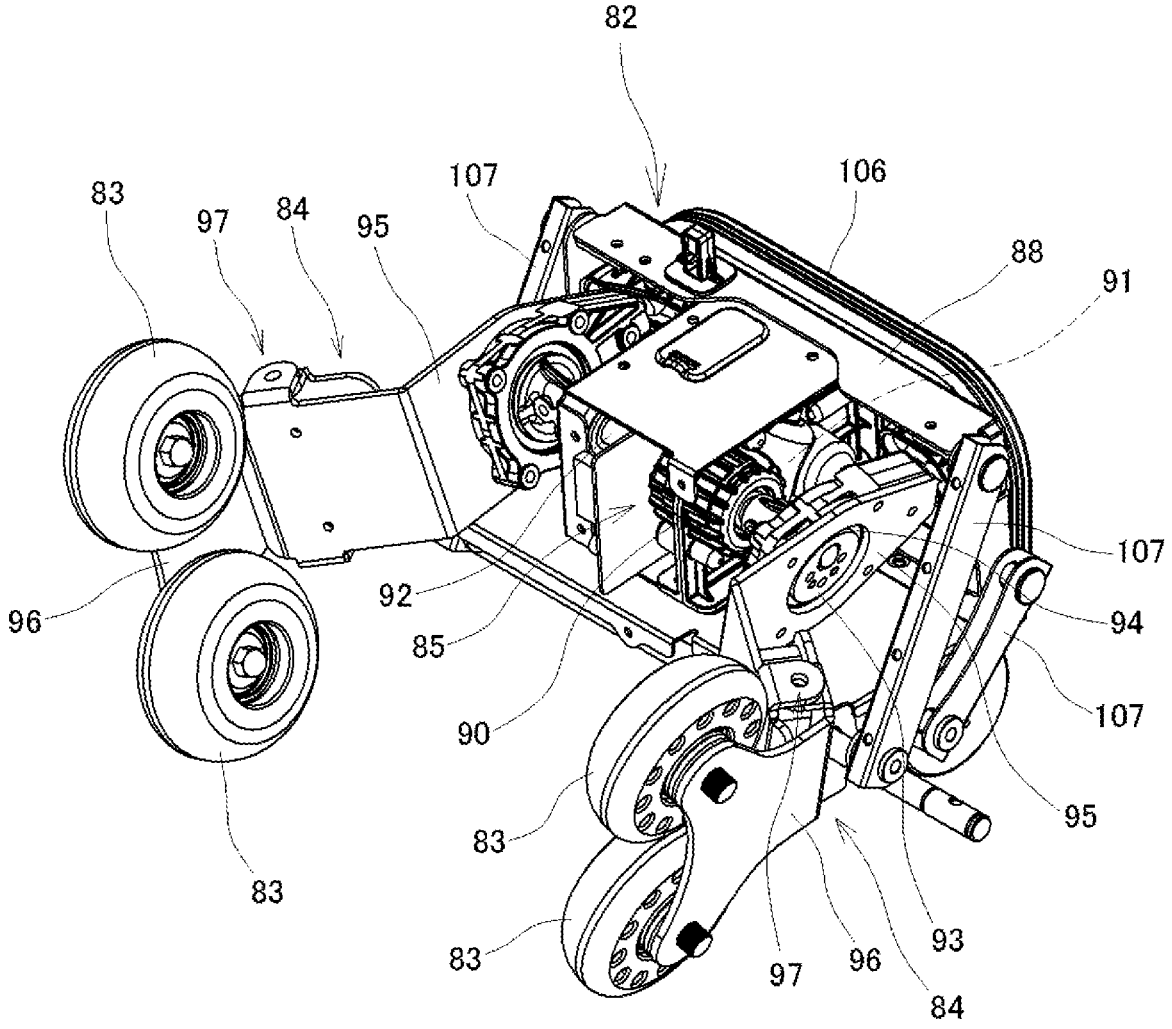
FIG. 13 is a perspective view of a frame.
Figure 14:
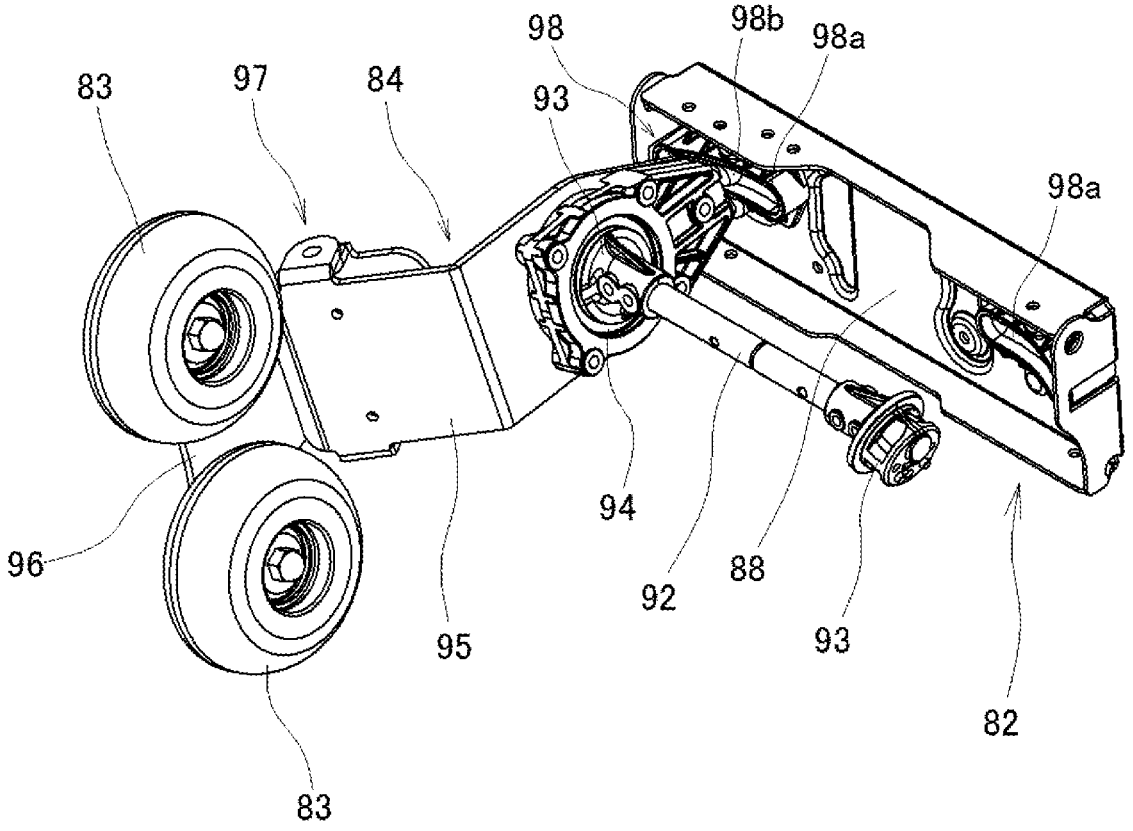
FIG. 14 is a perspective view of the frame in which components are partially omitted.
Figure 15:
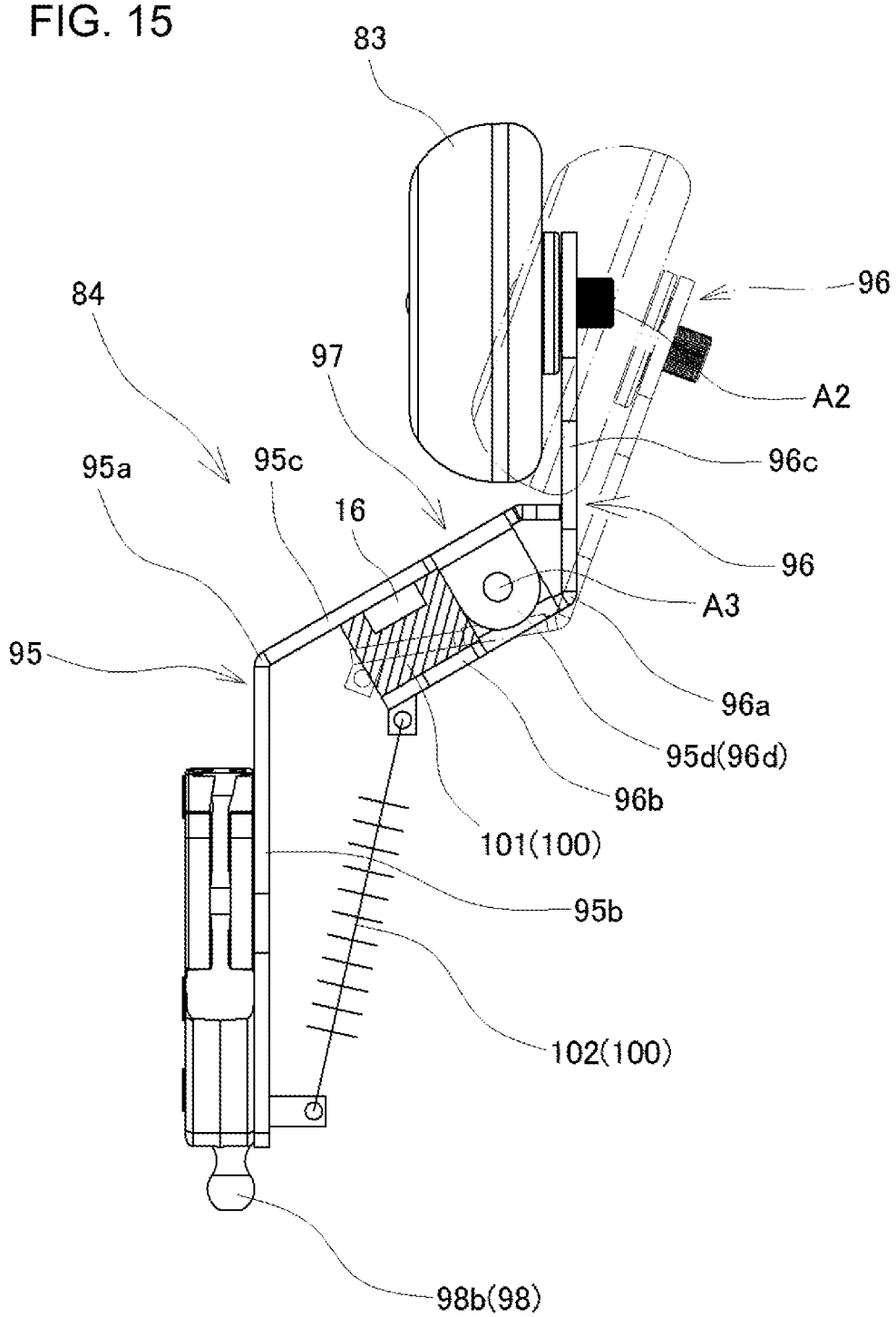
FIG. 15 is a bottom view of a treatment member and an arm.
Figure 16:
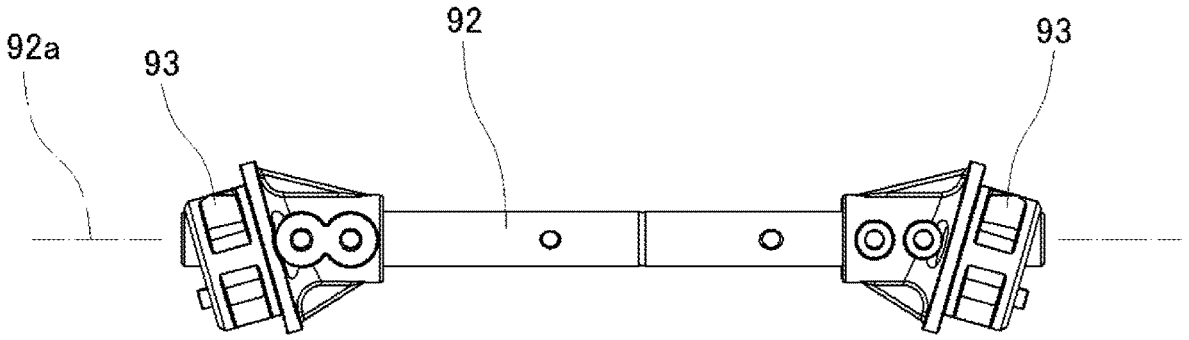
FIG. 16 is a front view of a drive shaft and an inclined shaft.
Figure 17:
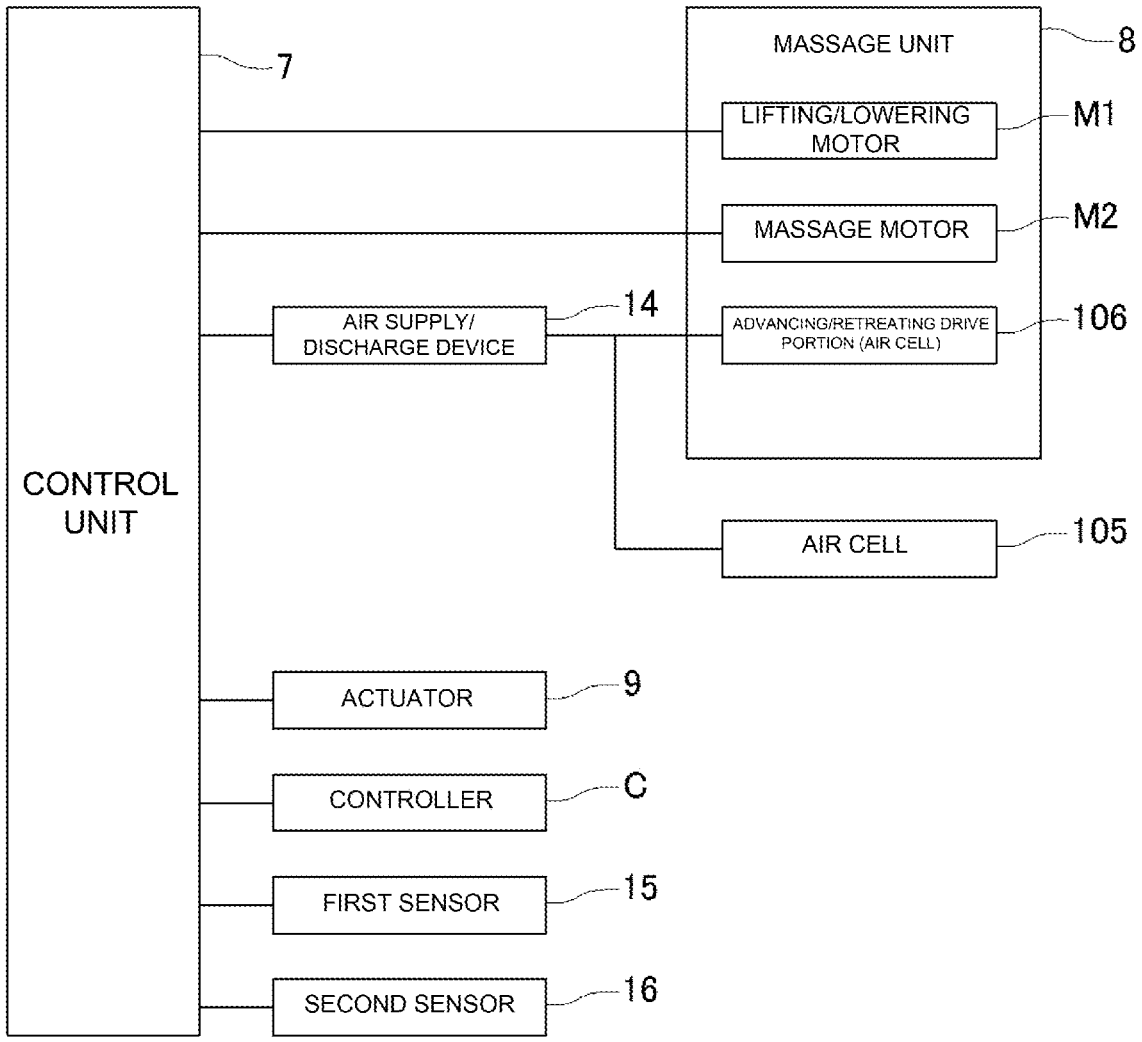
FIG. 17 is a block diagram of the massage machine.
Figure 18:
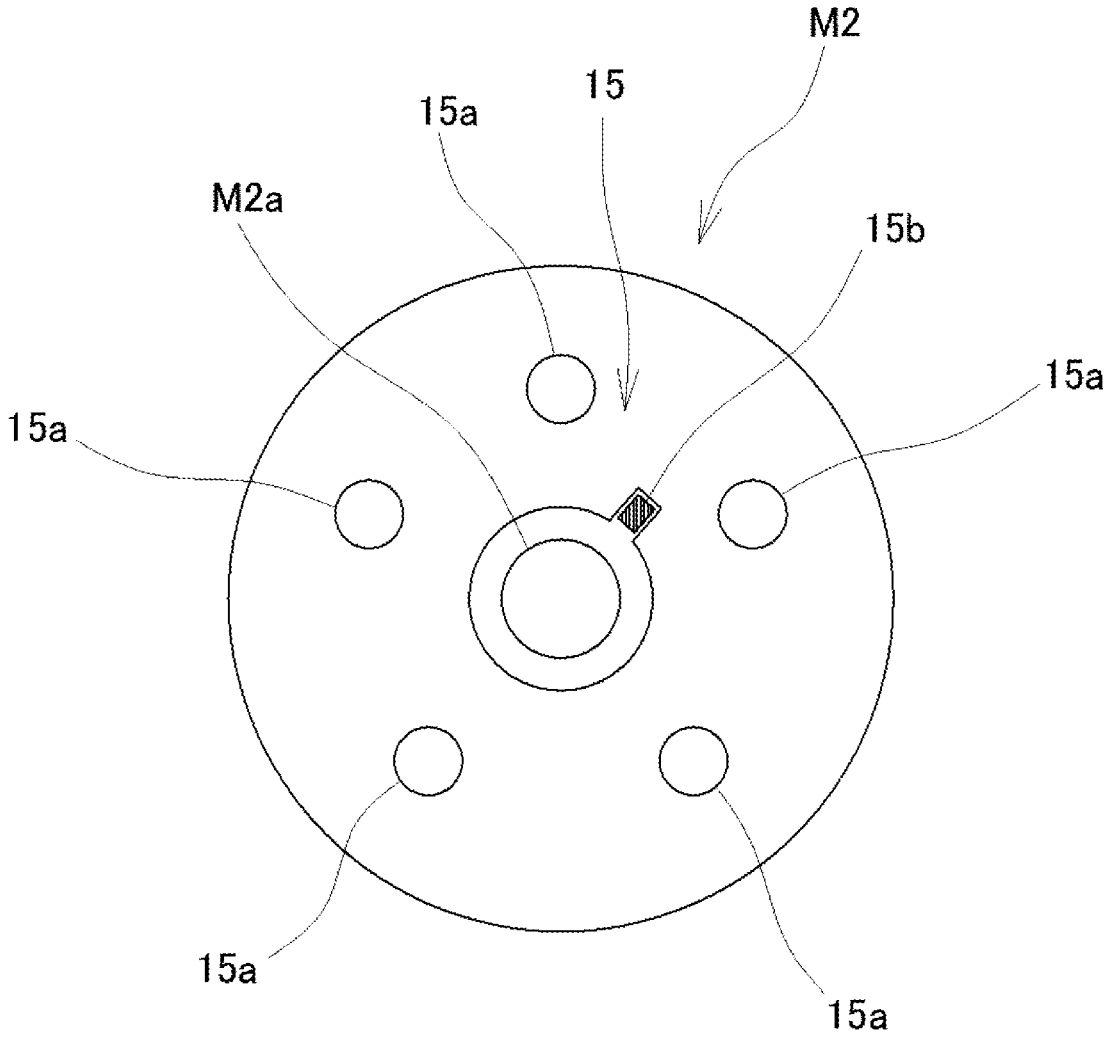
FIG. 18 is a view when a motor is viewed in an axial direction of an output shaft.

FIG. 10 is a perspective view of the massage unit 8. FIG. 11 is a front view of the massage unit 8. FIG. 12 is a plan view of the massage unit 8. FIG. 13 is a perspective view of a frame 82. FIG. 14 is a perspective view of the frame 82 in which components are partially omitted. FIG. 15 is a bottom view of a treatment member 83 and an arm 84. FIG. 16 is a front view of a drive shaft 92 and an inclined shaft 93. FIG. 17 is a block diagram of the massage machine 1. FIG. 18 is a view when a motor M2 is viewed in the axial direction of an output shaft M2*a*.

The massage unit 8 mainly has a base frame 81, the frame 82 supported by the base frame 81, the treatment members 83, the arms 84 forming a pair on the right and the left and supporting the treatment members 83, and a drive mechanism 85 driving the arms 84. In addition, the above-described control unit 7 controls an operation of the massage unit 8.

As illustrated in FIGS. 10 to 12, the base frame 81 has a bottom wall 81*a*, side walls 81*b* which are erected from both the right and left sides of the bottom wall 81*a* toward the front side, a lower wall 81*c* which is erected from a lower side of the bottom wall 81*a* toward the front side, and an upper wall 81*d* which is erected from an upper side of the bottom wall 81*a* toward the front side, thereby configuring a box shape having the open front side. The side wall 81*b* of the base frame 81 is provided with the pinions 86 which mesh with the rack 26*f* of the guide rail 26, and the guide rollers 87 which travel within the guide rail 26. There are provided a plurality of the pinions 86 (two in the present embodiment) and a plurality of the guide rollers 87 (two in the present embodiment) at a predetermined distance therebetween in the vertical direction. The pinion 86 on the lower side is interlocked with a motor (lifting/lowering motor) M1 and is driven to rotate in response to driving of the motor M1.

As illustrated in FIGS. 12 to 14, the frame 82 is provided inside the box-shaped base frame 81. The frame 82 includes a bottom wall 88 having a surface facing the bottom wall 81*a* of the base frame 81, and an intermediate wall 89 having facing surfaces 89*a* respectively facing the treatment members 83 on the right and the left. A case 90 accommodating the drive mechanism 85 is provided on the front side of the bottom wall 88. The drive mechanism 85 has a motor (massage motor) M2, a speed reducer 91 constituted by a worm gear and the like which reduce the drive force of the motor M2 and transfer the reduced drive force, and the drive shaft 92 which has the rightward/leftward direction of being interlocked with the motor M2 via the speed reducer 91, as the axial direction. In both the right and left ends of the drive shaft 92, there are respectively provided the inclined shafts 93 which are inclined with respect to a shaft center 92*a* of the drive shaft 92. As illustrated in FIG. 16, the axial directions of the inclined shafts 93 on the right and the left intersect each other so as to have a substantially inverted V-shape when viewed from the front side. The arm 84 (first arm 95, will be described later) is turnably supported by the inclined shaft 93 via a bearing 94.

As illustrated in FIGS. 13 to 15, the arms 84 form a pair on the right and the left, and each of the arm 84 is configured to have the first arm 95 which is turnably supported by the inclined shaft 93, and a second arm 96 which is supported by the first arm 95 via a movable portion 97. The arms 84 are configured to be made of a plate material formed of a steel plate having a plate surface substantially in the rightward/leftward direction and extend toward the front side. Since the arm 84 is supported by the inclined shaft 93, the arm 84 turns three-dimensionally when the drive shaft 92 rotates. In addition, there is provided a restriction member 98 which restricts the operation of the arms 84.

The restriction member 98 has a guide groove 98*a* provided in the bottom wall 88, and a slider 98*b* fitted in the guide groove 98*a* provided in the first arm 95. The guide groove 98*a* is provided on the front side of the bottom wall 88, and the groove is formed so as to be open on the front side and to be elongated in the rightward/leftward direction. The slider 98*b* is a guide pin which extends from the first arm 95 toward the back side and has a spherical member at the tip end. The restriction member 98 restricts co-rotation of the arms 84 along the drive shaft 92 and restricts the operation having the rightward/leftward direction as a main component. When the drive shaft 92 rotates, in regard to a relationship with respect to the lower limbs, the treatment members 83 approach and are separated with respect to the lower limbs, and in regard to a relationship between the treatment members 83 forming a pair on the right and the left, the treatment members 83 approach each other and are separated from each other.

The first arm 95 has a bent portion 95*a* positioned at a middle portion in the front/back direction; and a base portion 95*b* positioned on the back side and a tip portion 95*c* positioned on the front side interposing the bent portion 95*a* therebetween. The base portion 95*b* is supported by the drive shaft 92 via the inclined shafts 93, and the tip portion 95*c* is open transversely outward. The tip portion 95*c* of the first arm 95 includes a bracket 95*d* having a hole which is open in the vertical direction. The second arm 96 is supported by the first arm 95 so as to be able to turn in the rightward/leftward direction. The second arm 96 has a bent portion 96*a* positioned at a middle portion in the front/back direction; and a base portion 96*b* positioned on the back side and a tip portion 96*c* positioned on the front side interposing the bent portion 96*a* therebetween. In the vicinity of the bent portion 96*a*, there is provided a bracket 96*d* having a hole which is open in the vertical direction. The first arm 95 and the second arm 96 are interlocked with each other such that the plate surface included in the tip portion 95*c* of the first arm 95 and the plate surface included in the base portion 96*b* of the second arm 96 face each other. The treatment members 83 are supported by the tip portion 96*c* of the second arm 96 so as to be rotatable around a rotary shaft A2 in the rightward/leftward direction. There are provided a plurality of the treatment members 83 (two in the present embodiment) in the vertical direction.

In a state where the brackets 95*d* and 96*d* of the first arm 95 and the second arm 96 overlap each other in the vertical direction, a turning shaft A3 having the vertical direction as the axial direction is inserted through the holes of the brackets 95*d* and 96*d*. That is, the brackets 95*d* and 96*d* and the turning shaft A3 function as the movable portion 97 so as to allow the second arm 96 to turn in the rightward/leftward direction. In this manner, the second arm 96 is supported by the first arm 95 via the movable portion 97. Therefore, when the treatment members 83 come into contact with the lower limbs by a force equal to or greater than predetermined strength, the second arms 96 and the treatment members 83 are operable in a direction of being separated from the lower limbs, for example, from a position indicated by the solid line in FIG. 15 to a position indicated by the two-dot chain line. Therefore, a favorable kneading massage can be performed regardless of the difference of physical constitution. In addition, the drive shaft 92 has the rightward/leftward direction as the axial direction, the turning shaft A3 has the vertical direction as the axial direction, and the axial directions thereof intersect each other. According to the configuration, directions of the operation of the arm 84 performed in response to rotation of the drive shaft 92 and an operation of the arm 84 around the turning shaft A3 can substantially coincide with each other in the rightward/leftward direction.

As illustrated in FIG. 15, the arm 84 is provided with biasing means 100 for biasing the treatment member 83 in a direction of approaching the lower limbs. In the present embodiment, there are provided two types of the biasing means 100. As first biasing means 100, there is provided an elastic member 101 which is interposed between the first arm 95 and the second arm 96 and is made of rubber or the like. The elastic member 101 is on the back side beyond the movable portion 97 and is provided between the tip portion 95*c* of the first arm 95 and the base portion 96*b* of the second arm 96. The base portion 96*b* of the second arm 96 is pushed and moved transversely outward due to a restoring force of the elastic member 101, and the treatment member 83 is biased in the direction of approaching the lower limbs.

As a second biasing means 100, there is provided an elastic member 102 constituted by a tension spring or the like causing the first arm 95 and the second arm 96 to be interlocked with each other. In the present embodiment, on the back side beyond the movable portion 97, the base portion 95*b* of the first arm 95 and the base portion 96*b* of the second arm 96 are interlocked with each other. However, the interlocking place is not limited thereto. For example, the elastic member 102 may cause the second arm 96 and the base frame 81 or the frame 82 to be interlocked with each other. In addition, there may be provided only one of the two types of the elastic members 101 and 102 described above.

As illustrated in FIGS. 10 to 13, on the front side of the case 90, there is provided the intermediate wall 89 having the facing surfaces 89*a* respectively facing the treatment members 83 on the right and the left. In other words, the intermediate wall 89 is provided between the treatment members 83 on the right and the left. The lower limbs are positioned between the treatment members 83 and the intermediate wall 89 and a massage is performed. The intermediate wall 89 is configured to have a substantially triangle shape when viewed from above such that the facing surfaces 89*a* on the right and the left are positioned transversely outward from the front side toward the back side. On the facing surface 89*a*, there is provided an air cell 105 which expands and contracts in response to air supply/discharge. It is preferable that the air cell 105 has a configuration in which the back side is fixed to the facing surface 89*a* and the front side expands toward the treatment member 83 so as to be deployed as indicated by the two-dot chain line in FIG. 12. According to the transversely inward operation of the treatment member 83 and the transversely outward (toward the treatment member 83 side) expansion of the air cell 105, the lower limbs can be sandwiched. In addition, in place of or in addition to the air cell 105, a cushioning material (not illustrated) made of urethane or the like may be provided on the facing surface 89*a*.

In addition, it is preferable that the treatment member 83 is configured to be able to advance and retreat in the front/back direction. As illustrated in FIG. 13, in the massage unit 8 of the present embodiment, the frame 82 is movable in the front/back direction with respect to the base frame 81. The massage unit 8 has an advancing/retreating drive portion 106 which drives the frame 82 to advance and retreat, and a link 107 which guides movement of the frame 82. It is preferable that the advancing/retreating drive portion 106 is an air cell which drives the frame 82 to advance and retreat by expanding and contracting in response to air supply/discharge. However, without being limited to the air cell, the frame 82 may be driven by a motor. The air cell serving as the advancing/retreating drive portion 106 is provided between the bottom wall 81*a* of the base frame 81 and the bottom wall 88 of the frame 82 and expands so as to push and move the frame 82 toward the front side. In other words, an air cell 106 is provided on the back side beyond the treatment member 83.

When the air cell 106 contracts, the frame 82 retreats toward the back side due to a load from the body. The base frame 81 and the frame 82 may be interlocked with each other by using a tension spring or the like such that the frame 82 is biased toward the back side at all times. The disposition of the advancing/retreating drive portion 106 is not limited to the that described above. For example, the advancing/retreating drive portion 106 may be provided in the arm 84. In this case, the treatment member 83 can advance and retreat in the front/back direction by causing the arm 84 to advance and retreat, instead of the frame 82.

As illustrated in FIG. 17, as a drive system, the massage unit 8 has the motor M1 which moves the massage unit 8 in the height direction, the motor M2 which rotates the drive shaft 92 so as to cause the treatment members 83 to approach and be separated with respect to the lower limbs, and an air supply/discharge device 14 which supplies and discharges air with respect to the air cell 105 provided in the intermediate wall 89 and/or the air cell 106 serving as the advancing/retreating drive portion. Each thereof is electrically connected to the control unit 7 constituted by a programmable microcomputer or the like and is controlled to be driven. When a brushless motor or a servo motor is adopted as the motors M1 and M2, the rotational speed of the motors M1 and M2 can be minutely controlled.

In addition, there are provided sensors 15 and 16 which directly or indirectly detect a load applied from the lower limbs to the treatment members 83. In the present embodiment, there are provided two types of the sensors 15 and 16. However, the configuration is acceptable as long as at least any one thereof is provided. The first sensor 15 is provided in the motor M2. The sensor 15 indirectly detects the load applied from the lower limbs to the treatment members 83 by detecting the rotational speed of the motor M2. A change of a load applied from the lower limbs to the treatment members 83 appears as a change of the rotational speed of the motor M2. In other words, when the treatment members 83 further move to the lower limbs side in response to rotation of the drive shaft 92 from a state where the treatment members 83 are in contact with the lower limbs, the rotational speed of the motor M2 decreases. Meanwhile, when the treatment members 83 are separated in response to rotation of the drive shaft 92 from a state where the treatment members 83 are in contact with the lower limbs, the rotational speed of the motor M2 increases.

As illustrated in FIG. 18, the sensor 15 has a plurality of non-contact-type detection portions 15*a* (five in the present embodiment) provided around the output shaft M2*a* of the motor M2, and a target detection portion 15*b* constituted by a magnet or the like of which the presence or absence is detected by the detection portions 15*a* provided in the output shaft M2*a* of the motor M2. The detection portion 15*a* can detect the rotation position of the output shaft M2*a* having the target detection portion 15*b*. More specifically, the rotation position of the output shaft M2*a* can be grasped at a plurality of places (five places in the present embodiment). The sensor 15 detects the rotational speed of the motor M2 based on the change amount of the rotation position of the output shaft M2*a* within a predetermined time.

As illustrated in FIG. 15, the second sensor 16 is provided in the arm 84. Specifically, the sensor 16 is provided between the tip portion 95*c* of the first arm 95 and the base portion 96*b* of the second arm 96. The sensor 16 is configured by a pressure sensor, a pressure sensitive sensor, or the like directly detecting the load applied from the lower limbs to the treatment members 83. When the treatment members 83 further move to the lower limbs side in response to rotation of the drive shaft 92 from a state where the treatment members 83 are in contact with the lower limbs, the second arm 96 turns so as to pivot around the turning shaft A3 due to a reaction force from the lower limbs, and the base portion 96*b* approaches the tip portion 95*c* of the first arm 95. Therefore, the pressure detected by the sensor 16 becomes significant. Meanwhile, when the treatment members 83 are separated in response to rotation of the drive shaft 92 from a state where the treatment members 83 are in contact with the lower limbs, the second arm 96 turns so as to pivot around the turning shaft A3 due to a biasing force of the biasing means 100, and the base portion 96*b* is separated from the tip portion 95*c* of the first arm 95. Therefore, the pressure detected by the sensor 16 becomes small.

Hereinafter, with reference to FIG. 19, description will be given regarding a case where the operation of the massage unit 8 is controlled based on the sensor 15 detecting the rotational speed of the motor M2. FIG. 19 is a view describing controlling of the motor M2 and the air supply/discharge device 14 in accordance with a detection result of the sensor 15.

The sensor 15 can detect a plurality of levels regarding the rotational speed of the motor M2. Specifically, levels in five stages are set as the detection rotational speed of the motor M2 obtained through the sensor 15, and each level has a predetermined range. As the level becomes higher, the higher detection rotational speed of the motor M2 is set. A memory (not illustrated) of the control unit 7 stores data of an aimed rotational speed of the motor M2 corresponding to each level of the detection rotational speed of the motor M2. The control unit 7 controls driving of the motor M2 such that the rotational speed of the motor M2 coincides with the aimed rotational speed. However, when the sensor 15 detects that the rotational speed of the motor M2 falls from one level to a different level due to the change of a load from the treatment target site, the control unit 7 newly sets an aimed rotational speed corresponding to the different level and performs controlling so as to cause the rotational speed of the motor M2 to fall. The aimed rotational speed is configured to be changed not only based on the detection result of the sensor 15 but also to be changed along a time series in accordance with a program set in advance. Therefore, a favorably hand simulated massage can be performed.

Hereinafter, description will be specifically given with reference to an example. In a process of a massage in which the control unit 7 causes the motor M2 to normally rotate while having the aimed rotational speed of 28 rotations/second, according to the treatment members 83 approaching the treatment target site, when the load applied from the treatment target site to the treatment members 83 increases and the detection rotational speed of the motor M2 falls below 26 rotations/second which is the lower limit value corresponding to the level 4, the aimed rotational speed is set to 23 rotations/second corresponding to the level 3 and the motor M2 is driven. When the detection rotational speed of the motor M2 further falls and falls below 21 rotations/second which is the lower limit value corresponding to the level 3, the aimed rotational speed is set to 18 rotations/second corresponding to the level 2 and the motor M2 is driven. When the detection rotational speed of the motor M2 further falls and falls below 16 rotations/second which is the lower limit value corresponding to the level 2, the rotating direction of the motor M2 is inverted and the treatment members 83 are separated from the treatment target site. In this case, the aimed rotational speed is raised to 28 rotations/second corresponding to the level 1. As described above, by driving the motor M2, the treatment members 83 are slowly pressed from a state where the treatment members 83 are in contact with the treatment target site. Thereafter, the treatment members 83 can be quickly separated from the treatment target site. Accordingly, a hand simulated and modulated massage can be realized. When the detection rotational speed of the motor M2 falls below a predetermined value (for example, 16 rotations/second which is the lower limit value corresponding to the level 2), in place of inverting the rotating direction of the motor M2, driving may be temporarily stopped. According to such an operation, the treatment members 83 are slowly pressed from a state where the treatment members 83 are in contact with the treatment target site. Thereafter, the state can be maintained for a certain period of time. Accordingly, a pleasantly different hand simulated massage can be realized.

In addition, when the sensor 15 detects that the load applied from the treatment target site to the treatment members 83 increases or decreases to a predetermined value, the control unit 7 causes the air supply/discharge device 14 to discharge or supply air, thereby controlling the operations of the air cells 105 and 106. Hereinafter, description will be specifically given with reference to an example. In a process of a massage in which the control unit 7 causes the motor M2 to normally rotate while having the aimed rotational speed of 23 rotations/second, according to the treatment members 83 approaching the treatment target site, when the load applied from the treatment target site to the treatment members 83 increases and the detection rotational speed of the motor M2 falls below 21 rotations/second which is the lower limit value corresponding to the level 3, the air supply/discharge device is controlled such that air inside the air cells 105 and 106 is discharged.

Meanwhile, in a process of a massage in which the control unit 7 causes the motor M2 to normally rotate while having the aimed rotational speed of 18 rotations/second, when the aimed rotational speed is raised and the rotational speed of the motor M2 exceeds 20 rotations/second which is the upper limit value corresponding to the level 2, the air supply/discharge device 14 is driven such that air is supplied to the insides of the air cells 105 and 106. That is, when the sensor 15 detects that the rotational speed of the motor M2 falls to a predetermined speed, the control unit 7 controls the air supply/discharge device 14 such that air is discharged. In addition, when the sensor 15 detects that the rotational speed of the motor M2 rises to a predetermined speed, the control unit 7 controls the air supply/discharge device 14 such that air is supplied. The subject of air supply/discharge performed in accordance with the detection result of the sensor 15 may be both the air cells 105 and 106 or may be any one thereof.

Hereinafter, with reference to FIG. 20, description will be given regarding a case where the operation of the massage unit 8 is controlled based on the sensor 16 detecting the pressure applied from the treatment target site to the treatment members 83. FIG. 20 is a view describing controlling of the motor M2 and the air supply/discharge device 14 in accordance with a detection result of the sensor 16.

The sensor 16 can detect the pressure applied from the treatment target site to the treatment members 83. Specifically, levels in five stages are set as the pressure detected by the sensor 16. As the level becomes higher, the lower detection pressure is set. The memory (not illustrated) of the control unit 7 stores data of an aimed rotational speed of the motor M2 corresponding to each level of the detection pressure. The control unit 7 controls driving of the motor M2 such that the rotational speed of the motor M2 coincides with the aimed rotational speed. However, when the sensor 16 detects that the detection pressure increases from one level to a different level due to the change of a load from the treatment target site, the control unit 7 newly sets an aimed rotational speed corresponding to the different level and performs controlling so as to cause the rotational speed of the motor M2 to fall. The aimed rotational speed is configured to be changed not only based on the detection result of the sensor 16 but also to be changed along a time series in accordance with a program set in advance. Therefore, a favorably hand simulated massage can be performed.

Hereinafter, description will be specifically given with reference to an example. In a process of a massage in which the control unit 7 causes the motor M2 to normally rotate while having the aimed rotational speed of 28 rotations/second, according to the treatment members 83 approaching the treatment target site, when the load applied from the treatment target site to the treatment members 83 increases and the detection pressure obtained through the sensor 16 exceeds 37 kpa which is the predetermined value corresponding the level 4, the aimed rotational speed is set to 23 rotations/second corresponding to the level 3 and the motor M2 is driven. When the detection pressure further increases and exceeds 38 kpa which is the predetermined value corresponding to the level 3, the aimed rotational speed is set to 18 rotations/second corresponding to the level 2 and the motor M2 is driven. When the detection pressure further increases and exceeds 39 kpa which is the predetermined value corresponding to the level 2, the rotating direction of the motor M2 is inverted and the treatment members 83 are separated from the treatment target site. In this case, the aimed rotational speed is raised to 28 rotations/second corresponding to the level 1. As described above, by driving the motor M2, the treatment members 83 are slowly pressed from a state where the treatment members 83 are in contact with the treatment target site. Thereafter, the treatment members 83 can be quickly separated from the treatment target site. Accordingly, a hand simulated and modulated massage can be realized. When the detection pressure increases, for example, when the detection pressure exceeds 39 kpa which is the predetermined value corresponding to the level 2, in place of inverting the rotating direction of the motor M2, driving may be temporarily stopped. According to such an operation, the treatment members 83 are slowly pressed from a state where the treatment members 83 are in contact with the treatment target site. Thereafter, the state can be maintained for a certain period of time. Accordingly, a pleasantly different hand simulated massage can be realized.

In addition, when the sensor 16 detects that the load applied from the treatment target site to the treatment members 83 increases or decreases to the predetermined value, the control unit 7 causes the air supply/discharge device 14 to discharge or supply air, thereby controlling the operations of the air cells 105 and 106. Hereinafter, description will be specifically given with reference to an example. In a process of a massage in which the control unit 7 causes the motor M2 to normally rotate while having the aimed rotational speed of 23 rotations/second, according to the treatment members 83 approaching the treatment target site, when the load applied from the treatment target site to the treatment members 83 increases and the detection pressure obtained through the sensor 16 exceeds 38 kpa which is the predetermined value corresponding to the level 3, the air supply/discharge device 14 is controlled such that air inside the air cells 105 and 106 is discharged.

Meanwhile, in a process of a massage in which the control unit 7 causes the motor M2 to normally rotate while having the aimed rotational speed of 18 rotations/second, according to the treatment members 83 separated from the treatment target site, when the load applied from the treatment target site to the treatment members 83 decreases and the detection pressure obtained through the sensor 16 falls below 39 kpa which is the predetermined value corresponding to the level 2, the air supply/discharge device 14 is driven such that air is supplied to the insides of the air cells 105 and 106. That is, when the sensor 16 detects that the pressure increases to the predetermined value, the control unit 7 controls the air supply/discharge device 14 such that air is discharged. In addition, when the sensor 16 detects that the pressure decreases to the predetermined value, the control unit 7 controls the air supply/discharge device 14 such that air is supplied. The subject of air supply/discharge performed in accordance with the detection result of the sensor 16 may be both the air cells 105 and 106 or may be any one thereof.

Even if the degree of proximity of the treatment members 83 with respect to the treatment target site is the same, when muscles become stiff, the load applied from the treatment target site to the treatment members 83 increases, and when muscles are relaxed, the load applied from the treatment target site to the treatment members 83 decreases. Therefore, according to the configuration described above, when performing a massage while changing the aimed rotational speed of the motor M2 along a time series in accordance with a program set in advance, a massage can be performed with the strength in accordance with the state change of muscles changing during the massage or the stiffness of muscles varying depending on a user, in accordance with the detection result of the sensors 15 and 16. In addition, even if the movement amount of the treatment members 83 toward the treatment target site side is the same, when the physical constitution of a user is significant, the load applied from the treatment target site to the treatment members 83 increases, and when the physical constitution of a user is small, the load applied from the treatment target site to the treatment members 83 decreases. Therefore, according to the configuration described above, a massage can be performed with the same strength for any user regardless of physical constitution. In addition, the treatment members 83 do not excessively act on the treatment target site.

In addition, the massage machine 1 of the present invention is not limited to the illustrated embodiment and may have a different embodiment within the scope of the present invention.

The massage unit 8 may be applied to the upper half of the body and/or the buttocks as the treatment target site. In this case, in order to avoid unnecessary interference with respect to the treatment target site, it is preferable to remove the intermediate wall 89. In addition, a plurality of the massage units 8 may be provided along the height direction. For example, it is preferable to provide a first massage unit 8 which is movable across a range from the upper half of the body to the buttocks and from which the intermediate wall 89 is removed, and a second massage unit 8 which is movable across a range from the femoral region to lower thighs and has the intermediate wall 89. In addition to the massage unit 8, there may be provided an air cell which expands and contracts in response to air supply/discharge performed by the air supply/discharge device 14 and pressurizes the treatment target site such as the back, the waist, the buttocks, and the lower limbs.

The present invention can be applied to a massage unit which can perform a favorable kneading massage regardless of physical constitution, a massage machine having the massage unit, and a massage machine which performs a hand simulated massage as if a masseur executes the massage.

Although the invention is described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. Moreover, no element or component in this disclosure is intended to be dedicated to the public regardless of whether the element or component is explicitly recited in the following claims.

What is claimed is:

1. A massage unit comprising:

a base frame;

a wall that projects from the base frame, the wall comprises a surface;

a treatment member, the wall comprises an air cell that is expandable toward the treatment member;

an arm that supports the treatment member;

a drive shaft that supports the arm and causes the treatment member to advance to a treatment target site in an advance direction and retreat from the treatment target site, the drive shaft is supported on the base frame; and wherein the arm comprises a movable portion that causes the treatment member to move away from the treatment target site when the treatment member comes into contact with the treatment target site;

wherein the arm comprises biasing means for biasing the treatment member in the advance direction;

wherein the surface faces the treatment member, and the treatment member is configured to advance to and retreat from the surface, wherein the treatment member and the arm are configured to move relative to the air cell.

2. The massage unit according to claim 1, wherein the arm includes a first arm which is supported by the drive shaft, a second arm which is supported by the first arm via the movable portion, and a turning shaft which serves as the movable portion causing the second arm to be turnably interlocked with the first arm, and wherein the biasing means is configured to bias the second arm to the advance direction.

3. The massage unit according to claim 2, wherein the biasing means is an elastic member which is interposed between the first arm and the second arm.

4. The massage unit according to claim 2, wherein the biasing means is an elastic member that pulls a base portion on a side opposite to the treatment member side of the second arm.

5. The massage unit according to claim 2, further comprising:

an inclined shaft that is inclined with respect to a shaft center of the drive shaft, wherein the arm is supported by the drive shaft via the inclined shaft and extends toward the treatment target site side, wherein the massage unit further comprises:

a restriction member that restricts an operation of the arm performed in response to rotation of the drive shaft in a direction having an axial direction of the drive shaft as a main component, and wherein the drive shaft and the turning shaft are disposed such that the axial directions thereof intersect with each other.

6. The massage unit according to claim 1, the treatment member includes a first treatment member and a second treatment member;

the arm includes a first arm that supports the first treatment member;

the arm includes a second arm that supports the second treatment member;

the drive shaft that supports the first arm and the second arm and causes the first treatment member and the second treat member to advance to a treatment target site in an advance direction and retreat from the treatment target site; and wherein the first and second treatment members are separated from each other in response to rotation of the drive shaft.

7. A massage unit comprising:

a treatment member;

an arm that supports the treatment member;

a drive shaft that supports the arm and causes the treatment member to approach and be separated with respect to a treatment target site;

a motor that drives the drive shaft to rotate;

a control unit that controls driving of the motor; and a sensor configured to detect a plurality of levels regarding a rotational speed of the motor, wherein data of an aimed rotational speed of the motor corresponding to each level is stored in storage means of the control unit, and wherein when the sensor detects that the rotational speed of the motor falls from one level to a different level due to a change of a load from the treatment target site, the control unit newly sets an aimed rotational speed corresponding to the different level and performs controlling so as to cause the rotational speed of the motor to fall.

8. The massage unit according to claim 7, wherein when the sensor detects that the rotational speed of the motor falls from one level to a different level due to a change of a load from the treatment target site, the control unit inverts a rotating direction of the motor or performs controlling so as to stop driving of the motor.

9. The massage unit according to claim 7, wherein the motor is a brushless motor or a servo motor.

10. The massage unit according claim 7, further comprising:

an air cell that expands so as to cause the treatment member and the treatment target site to approach each other; and an air supply/discharge device that supplies and discharges air with respect to the air cell, wherein when the sensor detects that the rotational speed of the motor falls or rises to a predetermined level, the control unit causes the air supply/discharge device to discharge or supply air.

11. The massage unit according to claim 7, wherein the treatment member is able to massage lower limbs of a user.

12. A massage machine comprising:

a treatment member;

an arm that supports the treatment member;

a drive shaft that supports the arm and causes the treatment member to approach and be separated with respect to a treatment target site;

a motor that drives the drive shaft to rotate;

an air cell that expands so as to cause the treatment member and the treatment target site to approach each other;

an air supply/discharge device that supplies and discharges air with respect to the air cell; and a control unit that controls driving of the motor and the air supply/discharge device;

wherein the motor includes a sensor that directly or indirectly detects a load applied from the treatment target site to the treatment member;

wherein when the sensor detects that the load increases or decreases to a predetermined value, the control unit causes the air supply/discharge device to discharge or supply air;

wherein the sensor is configured to detect the load by detecting a rotational speed of the motor, and wherein when the sensor detects that the rotational speed of the motor falls or rises to a predetermined speed, the control unit causes the air supply/discharge device to discharge or supply air.

13. The massage machine according to claim 12, wherein the sensor is configured to detect pressure applied from the treatment target site to the treatment member, and wherein when the sensor detects that the pressure increases or decreases to a predetermined value, the control unit causes the air supply/discharge device to discharge or supply air.

14. The massage machine according to claim 12, wherein the air cell is configured to expand toward the treatment member.

15. The massage machine according to claim 12, further comprising:

a facing surface that faces the treatment member, wherein the air cell is provided on the facing surface, wherein the treatment member is configured to approach and be separated with respect to the facing surface, and wherein the treatment target site is configured to be sandwiched by the treatment member and the air cell.

16. The massage machine according to claim 12, wherein the air cell is provided in rear beyond the treatment member, and wherein the air cell expands and contracts in a manner that causes the treatment member to advance and retreat with respect to the treatment target site.

17. The massage machine according to claim 12, further comprising:

an inclined shaft that is inclined with respect to a shaft center of the drive shaft, wherein the arm is supported by the drive shaft via the inclined shaft and extends toward the treatment target site side.

18. The massage machine according to claim 12, the treatment member is a first treatment member;

the arm is a first arm that supports the first treatment member;

wherein the massage unit comprises:

a second treatment member;

a second arm that supports the second treatment member;

the drive shaft that supports the first arm and the second arm and causes the first treatment member and the second treat member to advance to a treatment target site in an advance direction and retreat from the treatment target site; and wherein the first and second treatment members approach each other and are separated from each other in response to rotation of the drive shaft.

19. The massage machine according to claim 12, wherein the massage unit is movable in a height direction.

20. The massage machine according to claim 12, wherein the treatment member is configured to massage lower limbs of a user.

21. The massage machine according to claim 12, wherein the sensor is attached about a drive shaft of the motor.

* * * * *